US011149995B2

(12) United States Patent
Jung et al.

(10) Patent No.: US 11,149,995 B2
(45) Date of Patent: Oct. 19, 2021

(54) EVAPORATOR AND REFRIGERATOR HAVING THE SAME

(71) Applicant: LG ELECTRONICS INC., Seoul (KR)

(72) Inventors: Kwangsoo Jung, Seoul (KR); Woocheol Kang, Seoul (KR); Geunhyung Lee, Seoul (KR); Gwinan Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/555,757

(22) PCT Filed: Aug. 1, 2016

(86) PCT No.: PCT/KR2016/008437
§ 371 (c)(1),
(2) Date: Sep. 5, 2017

(87) PCT Pub. No.: WO2017/078250
PCT Pub. Date: May 11, 2017

(65) Prior Publication Data

US 2018/0245826 A1 Aug. 30, 2018

(30) Foreign Application Priority Data

Nov. 5, 2015 (KR) ..... 10-2015-0155343

(51) Int. Cl.

| | |
|---|---|
| ***F25B 39/02*** | (2006.01) |
| ***F25B 47/02*** | (2006.01) |
| ***F25D 21/08*** | (2006.01) |
| ***F25D 21/06*** | (2006.01) |
| ***F25D 21/12*** | (2006.01) |
| ***F28F 17/00*** | (2006.01) |

(52) U.S. Cl.
CPC ..... *F25B 39/02* (2013.01); *F25B 39/024* (2013.01); *F25B 47/02* (2013.01); *F25D 21/06* (2013.01);
(Continued)

(58) Field of Classification Search
CPC ..... F25D 21/08; F25D 21/06; F25D 21/12; F25B 41/022; F25B 2313/0211;
(Continued)

(56) References Cited

U.S. PATENT DOCUMENTS 1,835,599 A * 12/1931 Hull ..... F25B 39/02 62/518
1,847,546 A * 3/1932 Wishart ..... F25B 39/02 62/224
(Continued)

FOREIGN PATENT DOCUMENTS

CN 1334433 2/2002
CN 104344645 2/2015
(Continued)

OTHER PUBLICATIONS

Chinese Office Action in Chinese Application No. 201680003987.X, dated Dec. 27, 2018, 15 pages.
(Continued)

*Primary Examiner* — Eric S Ruppert
*Assistant Examiner* — Kirstin U Oswald
(74) *Attorney, Agent, or Firm* — Fish & Richardson P.C.

(57) ABSTRACT

Disclosed is an evaporator including a case formed in an empty box type and having a storage chamber therein; a cooling tube formed on the case in a preset pattern and filled with refrigerant for cooling therein; a heating tube formed on the case in a preset pattern so as not to be overlapped with the cooling tube and filled with working fluid for defrosting therein; and a heating unit fixed to an external surface of the case corresponding to the heating tube and configured to heat the working fluid within the heating tube.

12 Claims, 15 Drawing Sheets

(52) U.S. Cl.
CPC ..... *F25D 21/08* (2013.01); *F25D 21/12* (2013.01); *F28F 17/00* (2013.01)

(58) Field of Classification Search
CPC ..... F25B 2347/02; F25B 2347/021; F25B 39/02; F25B 47/02; F25B 39/024; F28F 17/00
USPC ..... 62/276
See application file for complete search history.

(56) References Cited

U.S. PATENT DOCUMENTS 2,256,021 A * 9/1941 Furry ..... F25B 39/02 62/264
2,576,688 A * 11/1951 Landgraf ..... H05B 3/80 392/498
2,637,180 A * 5/1953 Atchison ..... F25D 21/08 62/276
2,663,158 A * 12/1953 Sanders ..... F25D 21/08 62/234
2,665,566 A * 1/1954 Grimshaw ..... F25D 21/08 62/276
2,665,567 A * 1/1954 Bixler ..... F25D 21/08 62/276
2,675,687 A * 4/1954 Philipp ..... F25D 23/087 62/275
2,685,634 A * 8/1954 Bartlowe ..... F25D 21/08 62/276
2,687,626 A * 8/1954 Bartlowe ..... F25B 41/40 62/276
2,688,855 A * 9/1954 Hilliker ..... F25B 41/20 62/151
2,691,871 A * 10/1954 Saler ..... F25B 39/024 62/276
2,701,455 A * 2/1955 Kleist ..... F25B 47/022 62/278
2,705,874 A * 4/1955 Binder ..... F25D 21/08 62/234
2,708,348 A * 5/1955 Philipp ..... F25D 21/08 62/154
2,746,270 A * 5/1956 Atchison ..... F25D 21/08 62/276
2,802,346 A * 8/1957 Simmons ..... F25D 21/08 62/276
2,806,360 A * 9/1957 Armentrout ..... F25B 39/02 62/518
2,819,858 A * 1/1958 Mittendorf ..... F25D 21/08 248/74.2
2,847,194 A * 8/1958 Collins ..... F25B 39/02 165/169
2,889,692 A 6/1959 Mcgrew
2,900,806 A * 8/1959 Wurtz ..... F25D 21/08 62/186
2,930,207 A * 3/1960 Carl ..... F25D 21/08 62/276
2,936,598 A * 5/1960 Gould ..... F25B 39/00 62/298
2,977,454 A * 3/1961 Volker ..... H05B 3/82 392/498
3,003,333 A * 10/1961 Lysen ..... F25D 11/022 62/199
3,008,304 A * 11/1961 Collins ..... F25D 21/08 62/276
3,046,753 A * 7/1962 Carapico, Jr. ..... F25C 1/08 62/132
3,082,213 A * 3/1963 Pugin ..... C09B 47/26 106/31.46
3,082,313 A * 3/1963 Jepson ..... A47J 37/105 219/441
3,109,910 A * 11/1963 Fogleman ..... G01K 7/24 219/209
3,195,320 A * 7/1965 Shoichi ..... F25D 21/008 62/276
3,247,680 A * 4/1966 Winkler ..... F25D 21/002 62/276
3,343,596 A * 9/1967 Kritzer ..... F25D 21/08 165/67
3,393,530 A * 7/1968 Koch ..... F25D 17/065 62/275
3,584,198 A * 6/1971 Doi ..... F24D 13/02 219/541
3,717,009 A * 2/1973 Butts ..... F25B 39/024 62/523
4,120,284 A * 10/1978 Cotsworth ..... F24S 10/753 126/659
4,147,037 A * 4/1979 Gelbard ..... B23P 15/26 62/113
4,347,433 A * 8/1982 Wojtecki ..... B23P 15/26 219/535
4,351,301 A * 9/1982 Allen ..... F02D 33/006 123/557
4,369,350 A * 1/1983 Kobayashi ..... F25D 21/08 219/201
4,395,623 A * 7/1983 Shimada ..... H05B 3/141 219/505
4,395,882 A * 8/1983 Kast ..... F24S 50/40 60/527
4,756,358 A * 7/1988 O'Neal ..... F25D 21/08 165/64
5,186,022 A * 2/1993 Kim ..... F25B 39/02 165/64
5,731,568 A * 3/1998 Malecek ..... H01M 10/615 219/209
5,765,384 A * 6/1998 Carlstedt ..... F25D 21/08 62/276
5,899,077 A * 5/1999 Wright ..... H01L 35/32 62/3.7
6,588,225 B1 * 7/2003 Hodgson ..... F25B 47/022 62/285
9,821,420 B2 * 11/2017 Kuehl ..... F28F 1/006
2002/0005270 A1 * 1/2002 Yoon ..... F28D 15/02 165/47
2002/0023744 A1 * 2/2002 Kim ..... F28F 1/32 165/177
2005/0178529 A1 * 8/2005 Suzuki ..... H01L 23/473 165/80.4
2006/0130514 A1 * 6/2006 Kim ..... F25B 39/02 62/446
2008/0104973 A1 * 5/2008 Hall ..... F25D 21/08 62/80
2013/0340631 A1 * 12/2013 Blixt ..... H05B 3/30 99/443 C

FOREIGN PATENT DOCUMENTS

EP 1178268 A2 * 2/2002 ..... B21D 53/045
GB 854771 11/1960
GB 854771 A * 11/1960 ..... F25B 39/024
JP 08-313144 11/1996
JP 08313144 A * 11/1996
JP 2004270954 9/2004
JP 2004270954 A * 9/2004
JP 2015152218 8/2015
JP 2015152218 A * 8/2015
KR 20-0201527 11/2000
KR 10-2007-0098164 10/2007
KR 20110121862 A * 11/2011
WO WO 2010128692 11/2010

OTHER PUBLICATIONS

Extended European Search Report in European Application No. 16862269.4, dated May 14, 2019, 8 pages.

* cited by examiner

EVAPORATOR AND REFRIGERATOR HAVING THE SAME

CROSS-REFERENCE TO RELATED APPLICATIONS

This application is the National Stage filing under 35 U.S.C. 371 of International Application No. PCT/KR2016/008437, filed on Aug. 1, 2016, which claims the benefit of earlier filing date and right of priority to Korean Application No. 10-2015-0155343, filed on Nov. 5, 2015, the contents of which are all hereby incorporated by reference herein in their entirety.

TECHNICAL FIELD

The present disclosure relates to an evaporator including a defrosting device for removing formed frost, and a refrigerator having the evaporator.

BACKGROUND ART

A refrigerator is an apparatus which includes a compressor, a condenser, an expansion valve and an evaporator, and maintains freshness of various foodstuffs for a long time, using heat transfer according to a phase change of refrigerant.

A freezing method of the refrigerator may be classified into a direct freezing and an indirect freezing. The direct freezing method is used to cool inside of a storage chamber by a natural convection of cold air of an evaporator and the indirect freezing is used to cool inside of a storage chamber by forcibly circulating cold air using a cooling fan.

In general, there has been adopted and used a roll-bond type evaporator in the direct freezing type refrigerator, which has a cooling flow path between two pressure-welded case sheets by pressure-welding two case sheets having an isolation member interposed therebetween and expanding the pressure-welded isolation member by blowing high pressure air thereinto.

In a driving procedure of the refrigerator, when a temperature difference is generated between an evaporator and ambient air, a phenomenon (frost formation) that moisture in the air is condensed and frozen on a surface of the evaporator may be generated. Such frost may cause a cooling efficiency of the evaporator to be lowered, and there may be inconvenience in that a natural defrosting has to be carried out for a predetermined time after forcibly turning off a compressor for defrosting.

DISCLOSURE OF THE INVENTION

Therefore, an aspect of the detailed description is to provide a roll-bond type evaporator which includes a defrosting device with a simplified structure, which is driven by a low voltage and which has easy maintenance and repair.

Another aspect of the detailed description is to provide a defrosting device capable of preventing defrost water generated by a defrosting operation from being in contact with a heater.

Still another aspect of the detailed description is to provide a defrosting device in which working fluid is smoothly circulated.

Technical Solution

To achieve these and other advantages and in accordance with the purpose of the present disclosure, as embodied and broadly described herein, there is provided an evaporator including a case formed in an empty box type and having a storage chamber therein, a cooling tube formed in a predetermined pattern within the case and filled with refrigerant for cooling therein, a heating tube formed in a predetermined pattern within the case so as not to be overlapped with the cooling tube and filled with working fluid for defrosting therein, and a heating unit fixed to an external surface of the case corresponding to the heating tube and configured to heat the working fluid within the heating tube.

In one embodiment disclosed herein, the heating unit may be fixed to a lower part of a bottom surface of the case.

In one embodiment disclosed herein, the heating tube may include: a chamber to which the heating unit may be fixed to heat the working fluid contained therein and including an outlet through which the working fluid which has been heated by the heating unit may be discharged and an inlet through which the working fluid which has been cooled may be collected; and a flow tube coupled to the inlet and the outlet, respectively, to form a flow path through which the working fluid flows.

In one embodiment disclosed herein, the chamber may be disposed at a bottom surface of the case or at a lower part of one side surface of the case.

In one embodiment disclosed herein, the flow tube coupled to the outlet may be extendedly formed toward an upper side of the case.

In one embodiment disclosed herein, a cross-sectional area of the outlet may be the same as or larger than that of the inlet.

In one embodiment disclosed herein, the heating unit may include: a mounting frame disposed so as to cover the chamber; a heater fixed to the mounting frame, a lead wire configured to electrically connect the heater to a controller; and a sealing member disposed so as to cover the heater.

In one embodiment disclosed herein, the chamber may be defined by an active heating part corresponding to a portion where the heater is disposed and a passive heating part corresponding to a portion where the heater is not disposed, and the inlet may be formed at the passive heating part to prevent the working fluid, which returns through the inlet after moving in the flow tube, from being reheated and flowing backward.

In one embodiment disclosed herein, the evaporator may further include a coupling member fixed to the case through the mounting frame.

In one embodiment disclosed herein, a heat-conductive adhesive may be interposed between the chamber and the mounting frame.

In one embodiment disclosed herein, the mounting frame may include: a base frame formed so as to correspond to the chamber; and a protrusion part formed to protrude toward a lower side from a rear surface of the base frame so as to cover at least part of the heater fixed to the rear surface of the base frame, and the sealing member may be contained in a recessed space formed by the protrusion part so as to cover the heater.

In one embodiment disclosed herein, the heater may include: a base plate formed of a ceramic material and fixed to a rear surface of the mounting frame; a heating element formed at the base plate and configured to generate heat when a drive signal is received from the controller; and a terminal formed at the base plate and configured to electrically connect the heating element to the lead wire.

In one embodiment disclosed herein, an insulation member may be interposed between a rear surface of the heater and the sealing member.

In one embodiment disclosed herein, the heating tube may be formed so as to cover at least part of the cooling tube.

In one embodiment disclosed herein, the chamber may be extendedly formed inwardly toward the cooling tube.

In one embodiment disclosed herein, the cooling tube may be formed so as to cover at least part of the heating tube.

In one embodiment disclosed herein, the outlet may include a first outlet and a second outlet provided at both sides of the chamber, respectively, the inlet may include a first inlet and a second inlet provided at both sides of the chamber, respectively, and the flow tube may be coupled to the first and second outlets, respectively, extendedly formed at both sides of the chamber, respectively, so as to be far from the chamber and extendedly formed so as to get near to the chamber and then coupled to the first and second inlets, respectively.

In one embodiment disclosed herein, the case may be formed by bending a plate type metal frame, first and second openings of the heating tube may be formed at one end of the metal frame, respectively, and the first and second openings may be coupled to each other by a connection piping so that the heating tube may form a circulation flow path of a closed loop type through which the working fluid is circulated, together with the connection piping.

To achieve these and other advantages and in accordance with the purpose of the present disclosure, as embodied and broadly described herein, there is also provided an evaporator, including a case formed in an empty box type and having a storage chamber therein; a cooling tube formed on the case in a preset pattern and filled with refrigerant therein; a heating unit provided on an external surface of the case; and a heating tube having both ends coupled to an inlet and an outlet of the heating unit, respectively, formed to enclose the case so as to radiate heat to the case by high temperature working fluid which is heated and transferred by the heating unit, wherein the heating unit includes: a heater case including an empty space therein and an inlet and an outlet formed at distant positions along a longitudinal direction, respectively; and a heater fixed to an external surface of the heater case and configured to heat the working fluid within the heater case.

At both sides of the heater case, may be provided first and second extension fins each downwardly extending from a bottom surface to cover both side surfaces of the heater attached to the bottom surface, and an insulation member may be filled in a recessed space which is formed by a rear surface of the heater and the first and second extension fins so as to cover the heater.

Advantageous Effect

According to the present disclosure, since the cooling tube through which refrigerant flows and the heating tube through which working fluid flows are formed on the case in a roll bond type, and the heating unit is fixed on an external circumferential surface so as to heat the working fluid within the heating tube, it is possible to provide an evaporator having a defrosting function with a simple structure.

In the above described evaporator, since the heating unit is fixed on an external surface of the case and configured to heat working fluid within the heating tube, repairing and maintenance may be facilitated when the heating unit is broken.

Further, when a plate type ceramic heater is applied as the heater, a defrosting device of high efficiency at a low power and a low cost may be embodied.

In addition, the sealing structure of the heater can be embodied by a configuration that the heater is mounted at a recessed space defined by a protrusion portion at a lower part of the mounting frame, and a sealing member is filled over the heater.

Further, the heater may not be disposed at an inlet side of the chamber, but disposed to correspond to an outlet side of the chamber so that a flowing structure in which working fluid flows smoothly without a backflow may be embodied.

Meanwhile, since the heat pipe which transfers working fluid heated by the heating unit is formed to surround the outside of the roll bond type case formed with the cooling tube, an evaporator having a defrosting function may be embodied. Such an evaporator may use a conventional roll bond type evaporator as it is, and may provide an advantage in that a defrosting device of high efficiency at a low power and a low cost may be embodied when a plate type ceramic heater is applied as a heater of a heating unit.

MODES FOR CARRYING OUT THE PREFERRED EMBODIMENTS

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated.

A structure applied to one embodiment may be equally applied to another embodiment unless there is any contradiction structurally and functionally.

A singular representation may include a plural representation unless it represents a definitely different meaning from the context.

In the present disclosure, that which is well-known to one of ordinary skill in the relevant art has generally been omitted for the sake of brevity.

The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Figure 1:
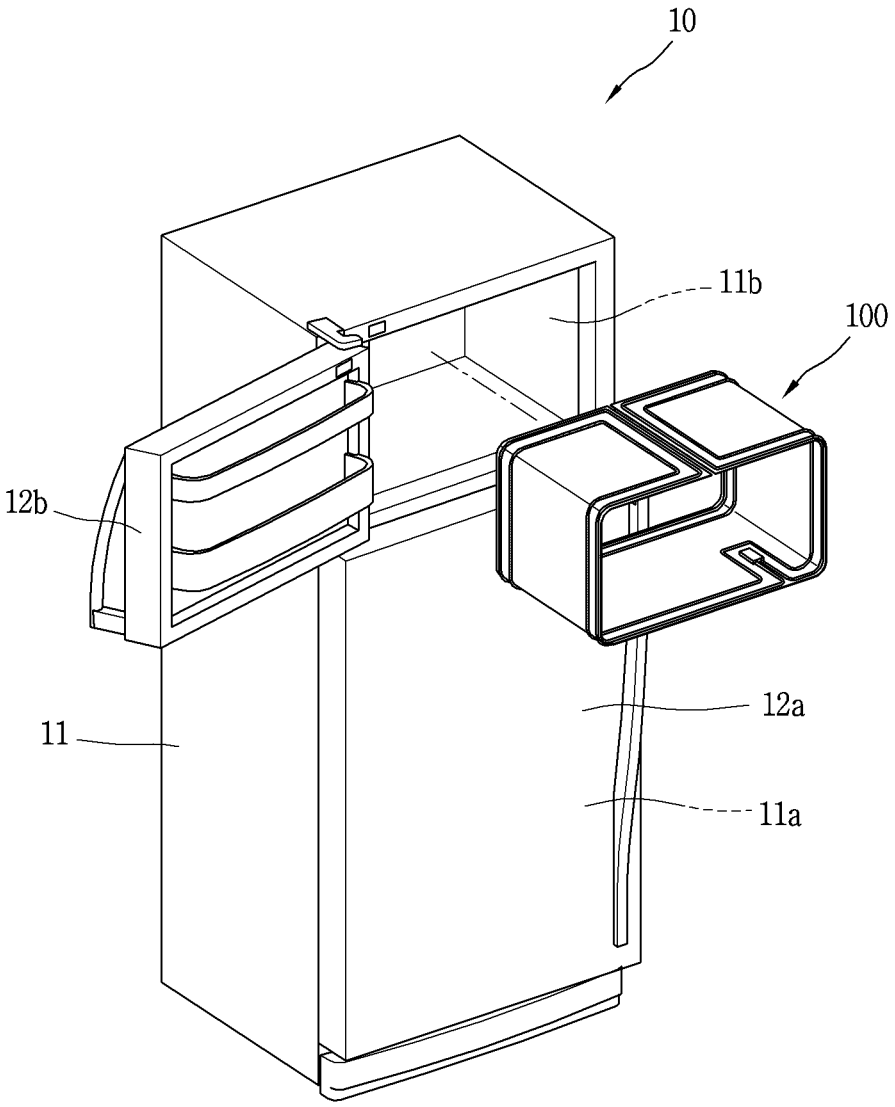
FIG. 1 is a conceptual view illustrating a refrigerator according to an embodiment of the present disclosure.

FIG. 1 is a conceptual view illustrating a refrigerator 10 according to an embodiment of the present disclosure.

The refrigerator 10 is a device for storing foods kept therein at a low temperature using cooling air generated by a refrigeration cycle in which processes of compression, condensation, expansion, and evaporation are sequentially carried out.

As shown, a refrigerator main body 11 is provided with a storage space. The storage space may be separated by a partition and may be divided into a refrigerating chamber 11*a* and a freezing chamber 11*b* according to a set temperature.

In this embodiment, though a top mount type refrigerator in which the freezing chamber 11*b* is disposed at an upper portion of the refrigerating chamber 111*a* is shown, the present disclosure is not limited thereto. The present disclosure may be applied to a side by side type refrigerator in which the refrigerating chamber and the freezing chamber are disposed at left and right sides and a bottom freezer type refrigerator in which the refrigerating chamber is disposed above the freezing chamber.

The refrigerator main body 11 is coupled to doors 12*a* and 12*b* so that a front opening of the main body 11 may be opened or closed. In the drawings, there is shown that a refrigerating chamber door 12*a* and a freezing chamber door 12*b* are disposed to open or close front portions of the refrigerating chamber 11*a* and the freezing chamber 11*b*, respectively. The doors 12*a* and 12*b* may be configured in various types, that is, a revolving type door which is rotatably coupled to the refrigerator main body 11, a drawer type door which is coupled to the refrigerator main body 11 in a slidably movable manner, and the like.

The refrigerator main body 11 is provided with a machine room (not shown) in which a compressor and a condenser are installed. The compressor and condenser are coupled to an evaporator 100 to form a refrigeration cycle.

Meanwhile, refrigerant (R) which is circulated in the refrigeration cycle absorbs ambient heat from the evaporator 100 with evaporation heat so that surroundings may be cooled. In such a procedure, when a temperature difference with ambient air is generated, a phenomenon (frost formation) that moisture in the air is condensed and frozen on the surface of the evaporator 100 is generated. To remove such a frost, a defrosting device is provided at the evaporator 100.

Hereinafter, a new type of evaporator 100 which is capable of reducing consumption electric power in a defrosting operation will be described.

Figure 2:
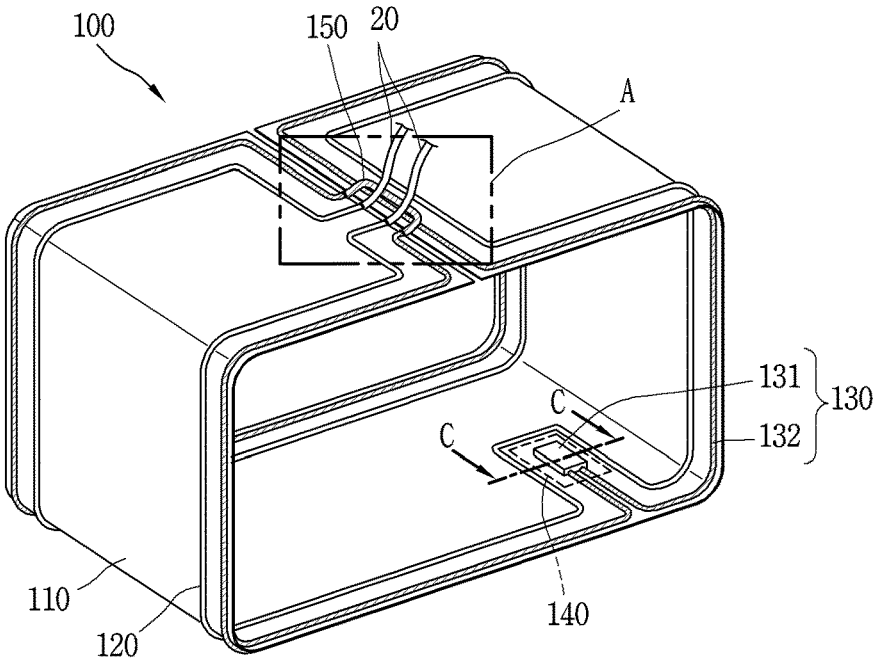
FIGS. 2 and 3 are conceptual views illustrating an evaporator applied to a refrigerator of FIG. 1, viewed from different directions, according to the present disclosure.
Figure 3:
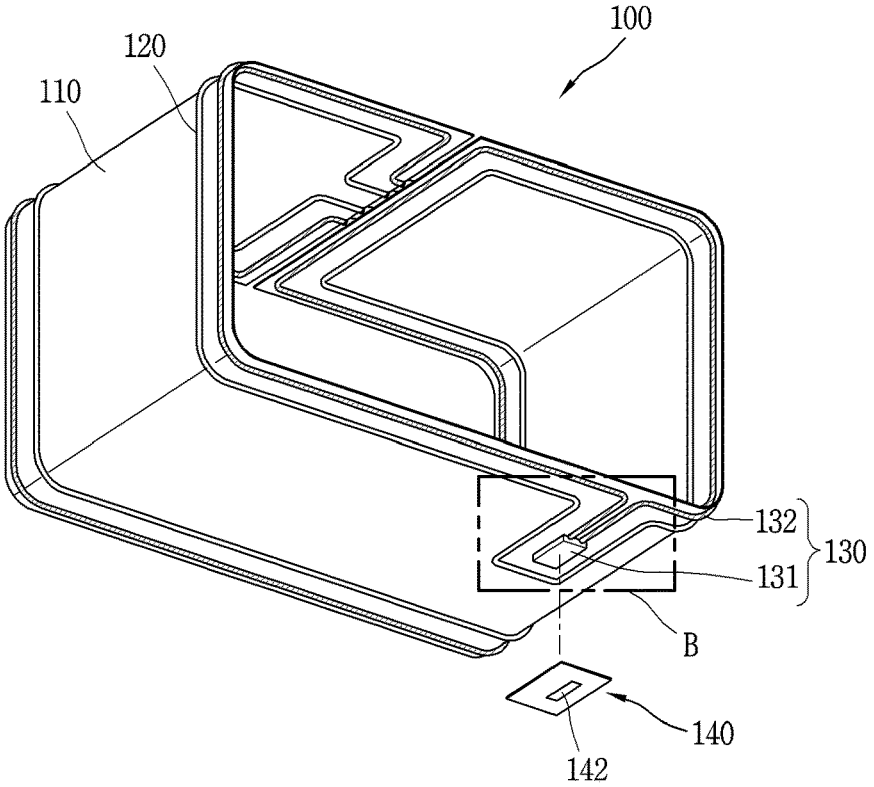
Figure 4:
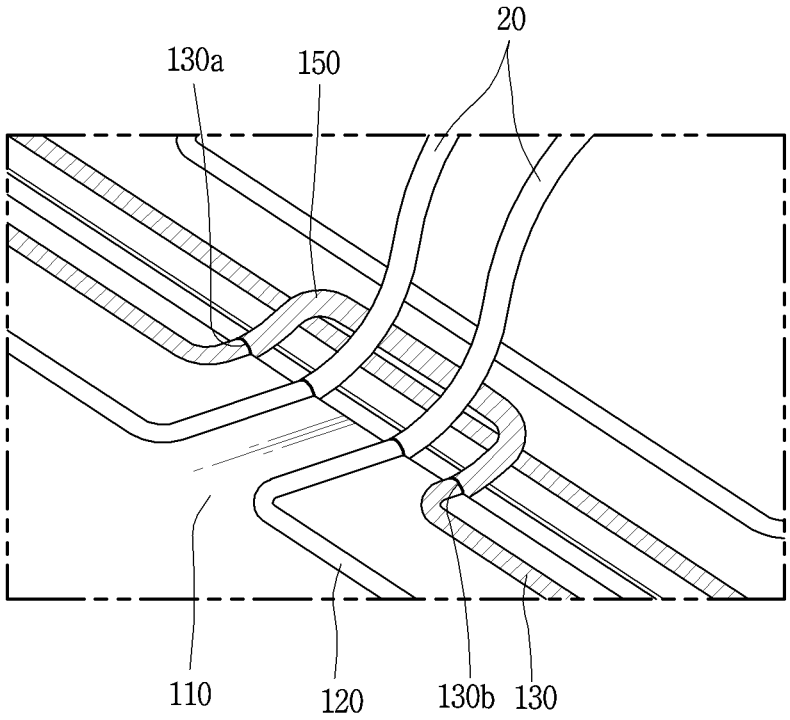
FIG. 4 is an enlarged view of a portion 'A' of FIG. 2.

FIGS. 2 and 3 are conceptual views illustrating the evaporator 100 applied to the refrigerator 10 of FIG. 1, viewed from different directions, according to a first embodiment of the present disclosure, and FIG. 4 is an enlarged view of a portion 'A' of FIG. 2.

Referring to FIGS. 2 through 4, the evaporator 100 according to the present disclosure includes a case 110, a cooling tube 120, a heating tube 130, and a heating unit 140. Among those components of the evaporator 100, the cooling tube 120 is relevant to a component for cooling and the heating tube 130 and the heating unit 140 are relevant to components for a defrosting operation.

The case 110 is formed in an empty box type and provides a storage chamber therein. The case 110 may form a storage chamber therein by itself, or may be formed to cover a housing (not shown) which is separately provided.

At the case 110, formed are a cooling tube 120 through which refrigerant (R) for cooling may flow and a heating tube 130 through which working fluid (W) for defrosting may flow. The cooling tube 120 and the heating tube 130 are formed on at least one surface of the case 110, and in the at least one surface of the case 110, a cooling flow path through which refrigerant (R) may flow and a heating flow path through which working fluid (W) may flow are formed, respectively, Hereinafter, a method for manufacturing the case 110 in which the cooling tube 120 and the heating tube 130 are formed will be described.

At first, a first case sheet 111 (refer to FIG. 8) and a second case sheet 112 (refer to FIG. 8) which are materials of the case 110 are prepared. The first and second case sheets 111 and 112 may be formed of metal (for instance, aluminum, steel, and the like) and may have a coating layer to prevent corrosion due to contact with moisture.

Then, a first separation member corresponding to the cooling tube 120 and a second separation member corresponding to the heating tube 130 are disposed on the first case sheet 111. The first and second separation members may be formed of graphite and are members which will be removed later.

Thereafter, the first and second case sheets 111 and 112 are disposed to face each other with the first and second separation members interposed therebetween, and the first and second case sheets 111 and 112 are pressed and integrated as one body, using a roller device (R).

As a result, a plate type frame formed by integrating the first and second case sheets 111 and 112 is formed and the first and second separation members are interposed therebetween. In this state, high pressure air is injected through the first and second separation members exposed to the outside.

The first and second separation members disposed between the first and second case sheets 111 and 112 are discharged from the frame by the injected high pressure air. In such a process, the space where the first separation member was disposed remains empty to form the cooling tube 120, and the space where the second separation member was disposed remains empty to form the heating tube 130.

In the process of discharging the first and second separation members by injecting the high pressure air, the portions where the first and second separation members were disposed are expanded to be relatively larger than the size of the first and second separation members.

According to the manufacturing method as above, the cooling tube 120 and heating tube 130 which are protruded to at least one surface of the frame are formed. For instance, when the first and second case sheets 111 and 112 have the same strength, the cooling tube 120 and the heating tube 130 are formed on both surfaces of the frame in a protruding manner. For another instance, when the first case sheet 111 has a higher strength than the second case sheet 112, the cooling tube 120 and the heating tube 130 are formed at the second case sheet 112 which has a relatively lower strength in a protrusion manner, and the first case sheet 111 which has a relatively higher strength is maintained flat.

The frame which has been integrated into one body in a plate type is bent, and formed as a case 110 in an empty box type, as shown in FIGS. 2 and 3.

Meanwhile, referring to FIG. 4, the cooling tube 120 formed on the case 110 is coupled to the evaporator and compressor through the cooling tube 20, thereby forming a refrigeration cycle.

Explaining this in an aspect of the manufacturing method, after manufacturing the case 110 having the roll bond type cooling tube 120, the cooling tube 20 is coupled to the inlet 131*b* and outlet 131*a* of the cooling tube 120, respectively, which is extended from the evaporator and compressor. The inlet 131*b* and outlet 131*a* of the cooling tube 120 may be formed at one end of the cooling tube 120, or may be portions which are exposed to the outside when part of the frame is cutout at a specific position. The cooling pipe 20 may be coupled to the cooling tube 120 by welding.

According to the configuration above, refrigerant for cooling is filled in the cooling tube 120, and the case 110 and air around the case 110 can be cooled by circulation of the refrigerant.

According to the present disclosure, since the roll bond type cooling tube 120 is integrally formed on the case 110, it is possible to enhance efficiency for heat exchange and simplify the manufacturing process, thereby reducing the manufacturing cost, compared to a structure in which the cooling tube 20 is mounted to the case 110.

In addition, working fluid (W) for defrosting is filled in the heating tube 130 which is formed on the case 110. For this purpose, in this embodiment, there is shown that the first and second openings 130*a* and 130*b* of the heating tube 130 are exposed to one end of the heating tube 130, but the present disclosure is not limited to this. The first and second openings 130*a* and 130*b* of the heating tube 130 may be portions which are exposed to the outside when a certain portion is cutout at a certain position of the frame.

The working fluid (W) is filled in the heating tube 130 through at least one of the first and second openings 130*a* and 130*b* and after filling the working fluid (W) the first and second openings 130*a* and 130*b* are blocked.

As the working fluid (W), may be used refrigerant (for instance, R-134a, R-600a, and the like), which is maintained as a liquid state under a cooling condition of the refrigerator 10, but transfers heat as a gas after changing a phase when heated.

In this embodiment, there is shown a configuration that the first and second openings 130*a* and 130*b* of the heating tube 130 are coupled to each other by the connection piping 150 so that the heating tube 130 forms a circulation path of a closed loop type with the connection piping 150 through which the working liquid (W) is circulated. The connection piping 150 may be coupled to the first and second openings 130*a* and 130*b* by welding, respectively.

Considering a temperature for radiating heat according to a filling amount in comparison with a total volume of the heating tube 130 and the connection piping 150, the filling amount of the working fluid (W) should be properly selected. According to an experimental result, it is preferable to contain the working fluid (W) in a liquid state more than 80% and less than 100% of the total volume of the heating tube 130 and the connection piping 150. When the filling amount of the working fluid (W) is less than 80%, an overheating of the heating tube 130 may occur, while when the filling amount of the working fluid (W) is 100%, the working fluid (W) may not be smoothly circulated.

The cooling tube 120 and heating tube 130 are formed on the case 110 in a preset pattern, but formed not to be overlapped with each other so that the refrigerant (R) which flows in the cooling tube 120 and the working fluid (W) which flows in the heating tube 130 form separate flow paths (a cooling flow path and a heating flow path), respectively.

In this embodiment, it is exemplary shown that the heating tube 130 is formed to cover at least part of the cooling tube 120. That is, the cooling tube 120 is formed within a heating flow path in a loop type which is formed by the heating tube 130.

A heating unit 140 is fixed to an external surface of the case 110 corresponding to the heating tube 130 to heat the working fluid (W) filled in the heating tube 130. In this embodiment, there is shown that the heating unit 140 is fixed to a lower portion of the bottom surface of the case 110. For reference, the heating unit 140 is schematically shown in FIG. 3.

The heating unit 140 is electrically coupled to a controller (not shown) to generate heat when receiving a control signal from the controller. For instance, the controller may be configured to apply drive signals to the heating unit 140 at every preset time interval, or apply drive signals to the heating unit 140 when a sensed temperature within a refrigerating chamber 11*a* or a freezing chamber 11*b* is lower than a preset temperature.

Hereinafter, a defrosting related structure of the evaporator 100 will be described more specifically.

Figure 5:
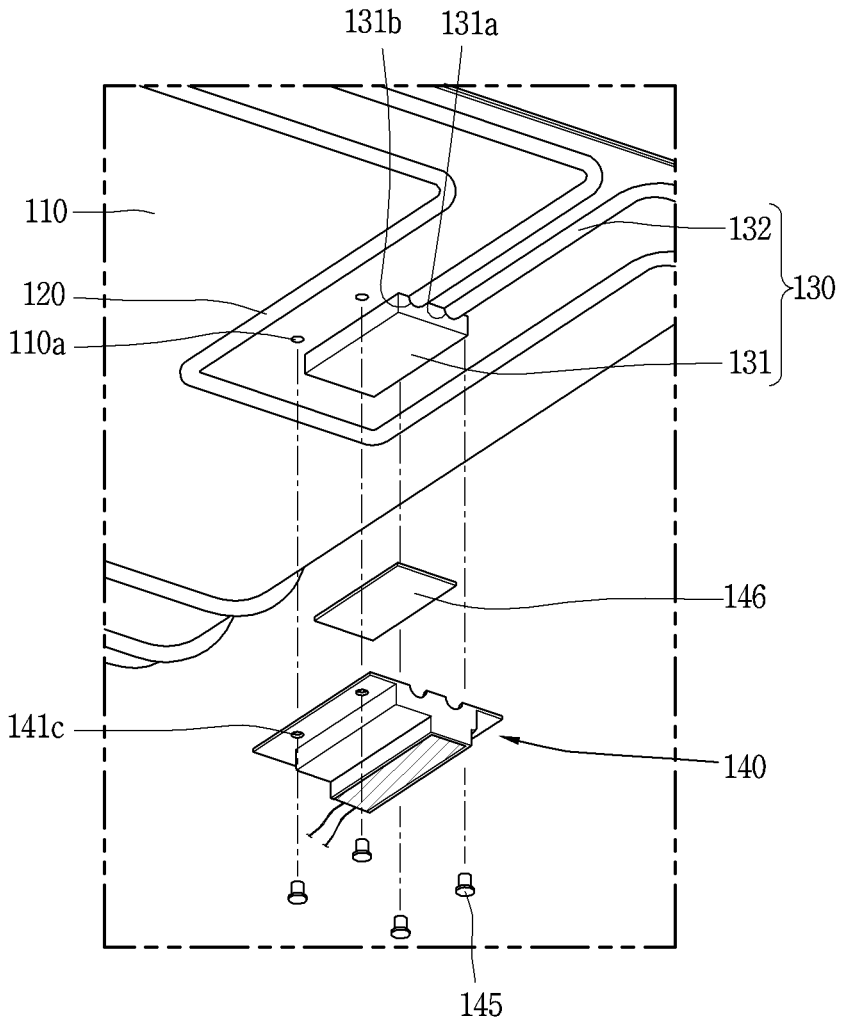
FIG. 5 is an enlarged view of a portion 'B' of FIG. 3.
Figure 6:
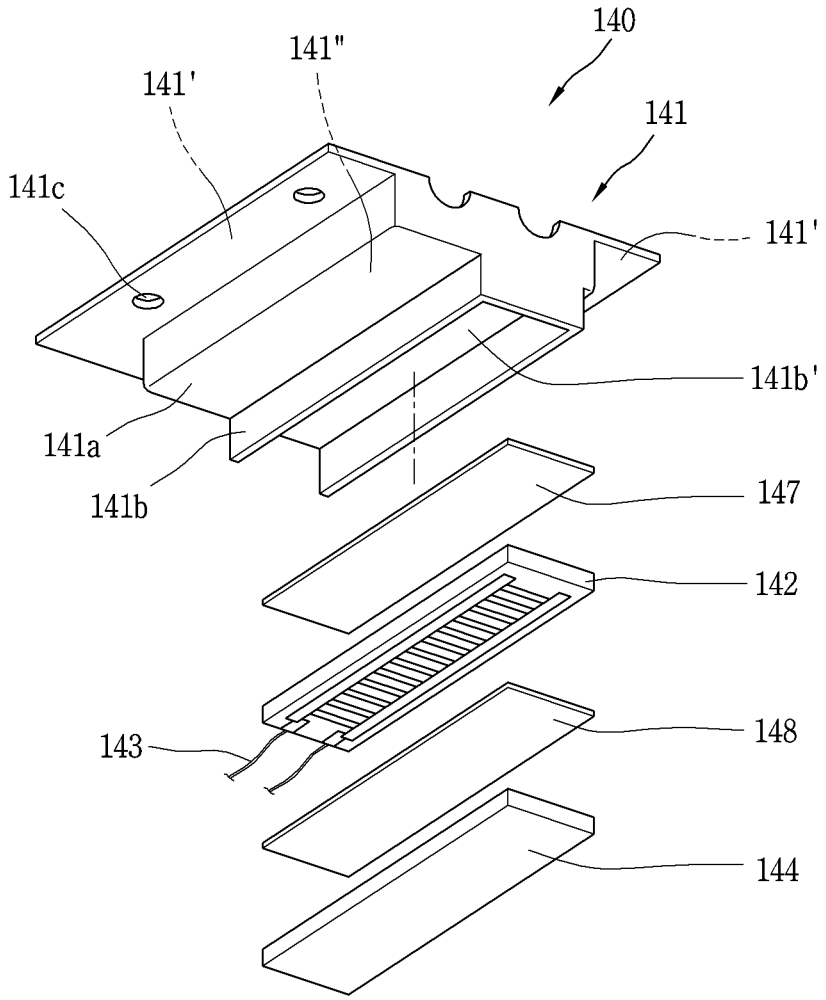
FIG. 6 is a disassemble view of a heating unit of FIG. 5.
Figure 7:
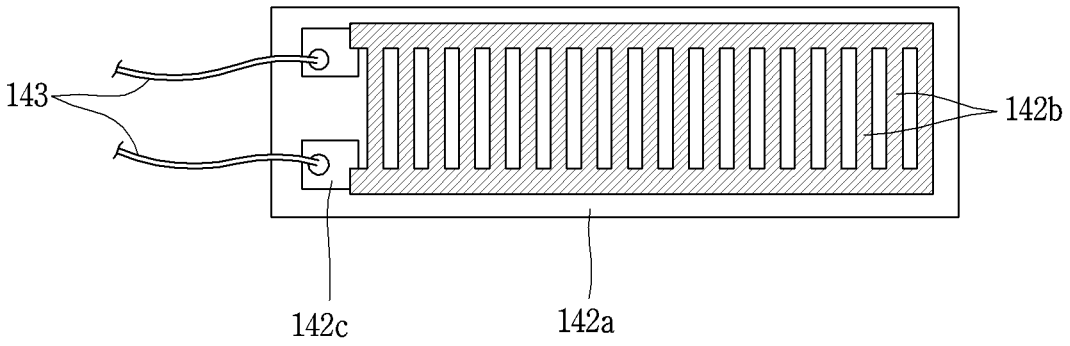
FIG. 7 is a conceptual view illustrating a heater of FIG. 6.
Figure 8:
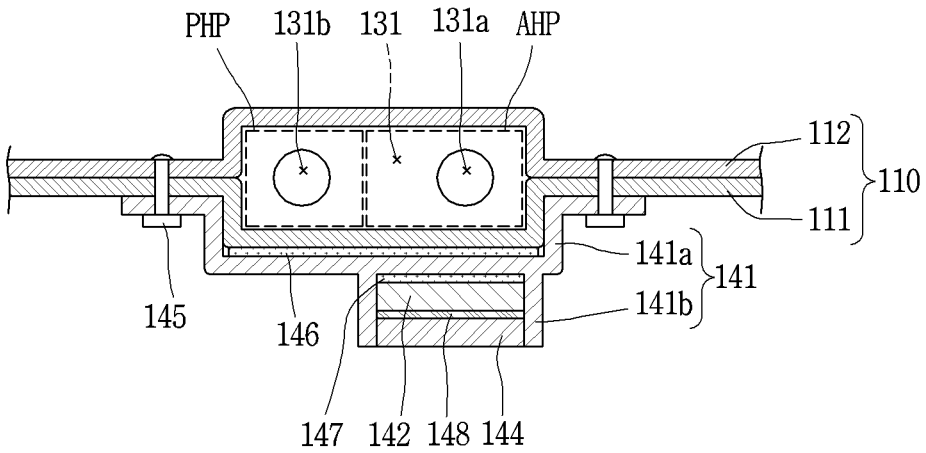
FIG. 8 is a sectional view taken along line "C-C" in FIG. 2.
Figure 9:
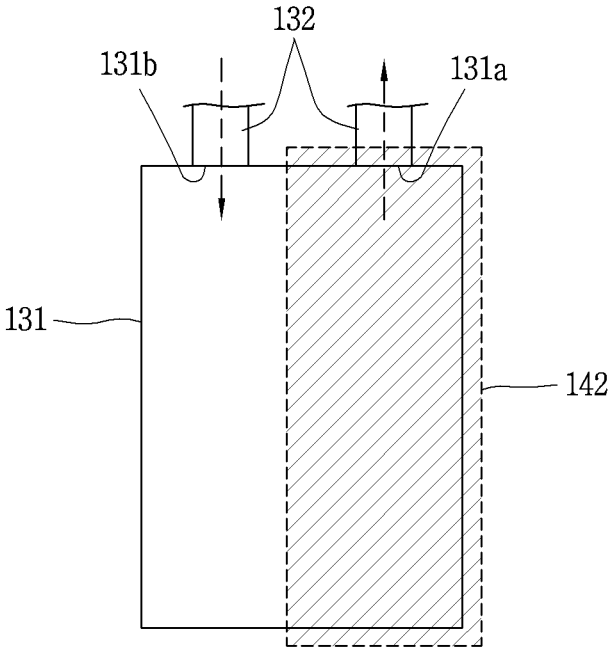
FIG. 9 is a conceptual view explaining an installation position of a heater within a chamber of FIG. 3.

FIG. 5 is an enlarged view of a portion 'B' of FIG. 3, FIG. 6 is a disassemble view of the heating unit 140 of FIG. 5, and FIG. 7 is a conceptual view illustrating a heater 142 of FIG. 6. Further, FIG. 8 is a sectional view taken along line "C-C" in FIG. 2, and FIG. 9 is a conceptual view illustrating an installation position of the heater 142 within a chamber 131 in FIG. 3.

Referring to FIGS. 5 through 9 with reference to the preceding drawings, the heating tube 130 is formed on the case 110 in a preset pattern so as not to be overlapped with the cooling tube 120, and working fluid (W) for defrosting is filled therein. The heating tube 130 includes a chamber 131 and a flow tube 132.

The chamber 131 has a predetermined area so as to contain a predetermined amount of working fluid (W) therein. A heating unit 140 is fixed to the chamber 131 to heat the working fluid (W) contained therein.

The chamber 131 includes an outlet 131*a* through which the working fluid (W) heated by the heating unit 140 is discharged, and an inlet 131*b* through which the working fluid (W) cooled while flowing in the flow tube 132 is collected. A cross-sectional area of the outlet 131*a* may be the same as or larger than that of the inlet 131*b*. According to this, the heated working fluid (W) may be smoothly discharged to the flow tube 132 through the outlet 131*a*, and it is possible to prevent some degree the heated working fluid (W) from being introduced into the flow tube 132 through the inlet 131*b* (back flowing).

The chamber 131 may be formed at a lower portion of the case 110. For instance, as shown, the chamber 131 may be formed at a bottom surface of the case 110. For another instance, the chamber 131 may be formed at a lower portion of one side surface of the case 110.

For reference, since the heating unit 140 for a heat source (strictly, the heater 142) is disposed to correspond to the chamber 131, the chamber 131 has the highest temperature in the heating tube 130. Accordingly, when the chamber 130 is formed at the bottom surface of the case 110, as in the above embodiment, it is possible to more efficiently remove frost which has been formed on the evaporator through an ascending convection current by heat and a heat transfer to both sides of the case 110.

Further, the chamber 131 may be formed at a portion which is spaced inwardly from a circumferential part of the case 110 in order to effectively utilize a high temperature of the heating unit 140 and chamber 131. Otherwise, the chamber 131 may be extendedly formed toward the inside of the cooling tube 120 which is formed within the loop type heating flow path provided by the heating tube 130.

The flow tube 132 is coupled to the outlet 131*a* and the inlet 131*b* of the chamber 131, respectively, to form a heating flow path. The flow tube 132 which is coupled to the outlet 131*a* may be formed extendedly toward the upper part of the case 110 so that a circulation flow by an ascending force of the heated working fluid (W) may be formed.

Referring to the preceding FIGS. 2 and 3, both ends of the flow tube 132 are coupled to the outlet 131*a* and inlet 131*b* of the chamber 131, respectively, and the flow tube 132 which is extended from the outlet 131*a* is extended to one side of the case 110, and then extended toward the upper part of the case 110. In this instance, the flow tube 132 which has been extended from the inlet 131*b* may be formed extendedly toward the upper part of the case 110 after extending to other side of the case 110. However, as shown, when a distance for the flow tube 132 which has been extended from the outlet 131*a* to reach one side of the case 110 is shorter than that for the flow tube 132 which has been extended from the inlet 131*b* to reach another side of the case 110, the heated working fluid (W) flows through the flow tube 131 which is extended from the outlet 131*a*.

Obviously, such a flow may be formed by positioning the inlet 131*b* at a passive heating part (PHP) which will be described hereinafter.

The flow tube 132 may be formed to cover at least part of the cooling tube 120 which is formed on the case 110, or may be formed along an inner circumference of the case 110, as shown herein.

In the drawings, there is shown that the chamber 131 is formed on a bottom surface of the case 110, and the flow tube 132 which is extended from the outlet 131*a* is extended toward one side surface (right side surface in the drawing) of the case 110, and thereafter extended toward the upper surface of the case 110. The working fluid (W) which is heated by the heating unit 140 moves upward along the heating flow path, as described above, by an ascending force.

Thereafter, the flow tube 132 is extended to a bottom surface after passing the one side surface, extended to another side surface (left side surface in the drawing) of the case 110, then extended to the upper surface of the case 110, then extended to the bottom surface after passing the another side surface again, and then finally coupled to the inlet 131*b* of the chamber 131.

In the drawings, between the flow tube 132 formed at a front side of the case 110 and the flow tube 132 formed at a rear side of the case 110, a cooling tube 120 is disposed, and a flowing direction of the working fluid (W) which flows in the flow tube 132 formed at the front side and that of the working flow (W) which flows in the flow tube 132 formed at the rear side are opposite to each other.

The heating unit 140 is fixed to an external surface of the case 110 which corresponds to the chamber 131, and configured to heat the working fluid (W) within the heating tube 130. The heating unit 140 includes a mounting frame 141, a heater 141, a lead wire 143 and a sealing member 144.

The mounting frame 141 is mounted to cover the chamber 131. In FIG. 5, there is shown a fixing configuration that the mounting frame 141 is fixed to the case 110 by coupling a coupling member 160 to a coupling hole 110*a* of the case 110 through a through-hole 141*c* of the mounting frame 141. The through-hole 141*c* may be provided at each corner of the mounting frame 141 outside the heater 142, and coupling holes 110*a* corresponding to the through-holes 141*c* may be provided outside the chamber 131.

The mounting frame 141 may be formed to have its side portions 141' bent so as to correspond to a circumferential surface of the case 110 and the chamber 131 which is protruded from the circumferential surface of the case 110. Both of the side portions 141' are disposed to come in contact with the circumferential surface of the case 110, and through-holes 141*c* are formed on the side portions 141*c*'. As both of the side portions 141' are bent, an intermediate portion 141" between the two side portions 141' is formed in a recessed form so as to accommodate the chamber 131 therein.

Further, as shown in FIGS. 5 and 8, a heat-conductive adhesive 146 may be interposed between the chamber 131 and the mounting frame 141. The heat-conductive adhesive 146 may be provided on a recessed bottom surface of the intermediate portion 141" of the mounting frame 141, as described above. The mounting frame 141 can be more firmly fixed to the case 110 by the heat-conductive adhesive 146, and as the heat-conductive adhesive 146 is filled up a gap between the chamber 131 and the mounting frame 141, a large amount of heat generated from the heater 142 can be transferred to the chamber 131.

The configuration for mounting the frame 141 to the case 110 is not limited to the above described one by the coupling member 160, as described above. For instance, the mounting frame 141 may be mounted to the case 110 by a hook coupling.

Meanwhile, the mounting frame 141 may be formed of a metallic material (for instance, aluminum, steel, and the like).

The heater 142 is fixed to a rear surface of the mounting frame 141. To fix the heater 142, a heat-conductive adhesive 147 may be interposed between the mounting frame 141 and the heater 142. The heater 142 may be formed in the form of a plate, and a plate type ceramic heater may be representatively used.

Referring to FIG. 7, the heater 142 may include a base plate 142*a*, a heating element 142*b* and a terminal 142*c*.

The base plate 142*a* is formed in a plate type and fixed to a rear surface of the mounting frame 141. The base plate 142*a* may be formed of a ceramic material.

The heating element 142*b* is formed on the base plate 142*a* which is configured to generate heat when receiving a control signal from the controller. The heating element 142*b* may be formed by patterning a resistor (for instance, mixed powder of platinum and ruthenium, tungsten, and the like) on the base plate 142*a* in a predetermined pattern.

At one side of the base plate 142*a*, the terminal 142*c* which is electrically connected with the heating element 142*b* is provided, and the lead wire 143 which is electrically conned to the controller is connected with the terminal 142*c*.

Under such a configuration, when a control signal is generated from the controller, the control signal is transmitted to the heater 142 via the lead wire 143, and the heating element 142*b* of the heater 142 generates heat upon application of a power. The heat generated from the heater 142 is transferred to the chamber 131 via the mounting frame 141 so that the working fluid (W) within the chamber 131 is heated at a high temperature.

Meanwhile, since the heating unit 140 is provided at the evaporator 100, defrost water collected by defrosting may flow in the heating unit 140 due to its structure. As the heater 142 included in the heating unit 140 is an electronic component, there may be a short circuit when the heater 142 contacts the defrost water. As such, in order to prevent moisture including the defrost water from being introduced into the heater 142, a sealing member 144 for covering and sealing the heater 142 may be provided.

For reference, water removed by a defrosting device, that is, defrost water is collected to a defrost water tray (not shown) which is disposed at a lower part of the refrigerator main body 11 through a defrost water discharge tube (not shown).

Hereinafter, an example of the configuration for sealing the heater 142 will be more specifically described.

The mounting frame 141 includes a base frame 141*a* and a protrusion portion 141*b*. The base frame 141*a* is formed to correspond to the chamber 131. As described before, both side portions 141' of the base frame 141*a* may be bent to accommodate therein the chamber 131 where the side portions 141' are disposed to come in contact with a circumferential surface of the case 110 and an intermediate portion 141" is formed to protrude from the circumferential surface. At the side portions 141' of the base frame 141*a*, through-holes 141*c* through which a coupling member passes are formed.

At a rear surface of the base frame 141*a*, the heater 142 is fixed. The heater 142 is fixed to a rear surface of the frame 141*a* which corresponds to the intermediate portion 141", considering that the intermediate portion 141" of the base frame 141*a* is disposed to correspond to the chamber 131.

The protrusion portion 141*b* is protrudingly formed on a rear surface of the base frame 141*a* toward a lower side so as to cover at least part of the heater 142 which is fixed to a rear surface of the base frame 141*a*. In FIGS. 5 and 6, there is shown that the protrusion portion 141*b* is formed in the form of "E" to cover a remaining portion except one side of the heater 142. The reason why the protrusion portion 141*b* is not formed at the one side of the heater 142 is to avoid interference with the lead wire 143 which is extended from the one side of the heater 141.

However, the present disclosure is not limited to the above embodiment. The protrusion portion 141*b* may be formed in the form of "□" to completely cover the heater 142. In this instance, at the protrusion portion 141*b* which faces the one side of the heater 142, may be formed a recess or a hole through which the lead wire 143 extended from the one side of the heater 142 passes.

The sealing member 144 fills a recessed space 141*b*' which is formed by the protrusion portion 141*b* to cover the heater 142. As for the sealing member 144, silicon, urethane, epoxy, and the like may be used. For instance, the sealing structure of the heater 142 may be completed through a hardening process after filling the recessed space 141' with epoxy in a liquid state so as to cover the heater 142. In this instance, the protrusion portion 141*b* functions as a side wall for defining the recessed space 141*b*' in which the sealing member 144 is contained.

Between the rear surface of the heater 142 and the sealing member 144, an insulation member 148 may be interposed. As for the insulation member 148, a mica sheet made of a mica material may be used. By disposing the insulation member 148 at the rear surface of the heater 142, it is possible to limit heat transfer to the rear surface of the heater 142 when heat is generated upon application of a power. Thus, melting of the sealing member 144 due to heat transfer may be prevented.

Meanwhile, referring to FIGS. 8 and 9, the chamber 131 is divided into an Active Heating Part (AHP) which corresponds to a portion where the heater 142 is disposed and a Passive Heating Part (PHP) which corresponds to a portion where the heater 142 is not disposed.

The active heating part (AHP) is a portion which is directly heated by the heater, and the working fluid (W) in a liquid state is heated at the active heating part (AHP) to have a phase change into high temperature gas.

The active heating part (AHP) may be disposed to correspond to the outlet 131*a* of the chamber 131. For instance, the outlet 131*a* of the chamber 131 may be disposed within the active heating part (AHP), or the active heating part (AHP) may be disposed between the outlet 131*a* and the inlet 131*b*.

In this embodiment, there is exemplary shown that the heater 142 is not disposed at the inlet 131*b* of the chamber 131, but disposed to correspond to the outlet 131*a* of the chamber 131. As shown in FIG. 9, the heater 142 may be disposed so as to cover the outlet 131*a* and the flow tube 132 which is extended from the outlet 131*a*. In this configuration, the outlet 131*a* of the chamber 131 is disposed within the active heating part (AHP).

The passive heating part (PHP) is not directly heated by the heater 142 unlike the active heating part (ACP), but indirectly heated to a predetermined temperature level. Here, the passive heating part (PHP) causes the working fluid (W) in a liquid state to have a temperature increase to a predetermined level, but does not have a high temperature enough to phase-change the working fluid (W) into a gas state. That is, in a viewpoint of temperature, the active heating part (AHP) forms a relatively high temperature part and the passive heating part (PHP) forms a relatively low temperature part.

Assuming that the working fluid (W) is made to directly return to the active heating part (AHP) of high temperature, the collected working fluid (W) may be reheated to backflow without being smoothly fed back to the chamber 131. This may disturb a smooth circulation flow of the working fluid (W) within the chamber 131, resulting in an overheating of the heater 142.

To solve such a problem, the passive heating part (PHP) may be disposed to correspond to the inlet 131*b* of the chamber 131. As a result, since it is configured that the working fluid (W) which returns after moving in the flow tube 132 is not directly introduced into the active heating part (AHP), it is possible to prevent a backflow of the working fluid (W) due to reheating.

In this embodiment, there is shown that the inlet 131*b* of the chamber 131 is disposed within the passive heating part (PHP) so that the working fluid (W) which returns after moving in the flow tube 132 is introduced into the passive heating part (PHP). That is, the inlet 131*b* of the chamber 131 is formed at a portion where the heater 142 is not disposed.

Further, in this embodiment, there is shown that the heater 142 is not disposed along an extended direction of the flow tube 132 which is coupled to the inlet 131*b* of the chamber 131. According to this embodiment, the returning working fluid (W) is not heated by the heater 142 when flowing in the chamber 131, but when the returned working fluid (W) flows in the active heating part (AHP) while forming an eddy flow within the chamber 131, the returned working fluid (W) is reheated by the heater 142 and then discharged to the outlet 131*a*.

As described above, to prevent the backflow of the working fluid (W), the heater 142 has to be mounted to correspond to a preset portion of the chamber 131. Since the heater 142 is mounted at a recessed space 141*b*' which is defined by the protrusion portion 141*b*, a mounting position of the heater 142 may be determined by a forming position of the protrusion portion 141*b*.

Considering this, when mounting the mounting frame 141 to the case 110, the protrusion 141*b* is configured such that the recessed space 141*b*' is formed at a position corresponding to the active heating part (AHP). Accordingly, the heater 142 mounted at the recessed space 141*b*' which is defined by the protrusion portion 141*b* is mounted to correspond to a position that is out of the inlet 131*b* of the chamber 131 when the mounting frame 141 is mounted to the case 110.

Figure 10:
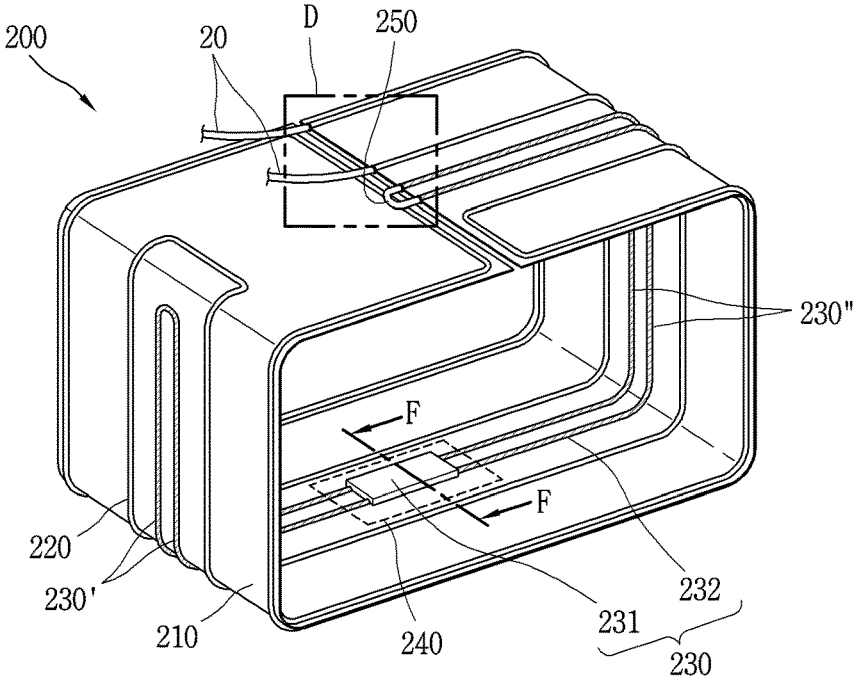
FIGS. 10 and 11 are conceptual views illustrating a second example of the evaporator applied to the refrigerator of FIG. 1.
Figure 11:
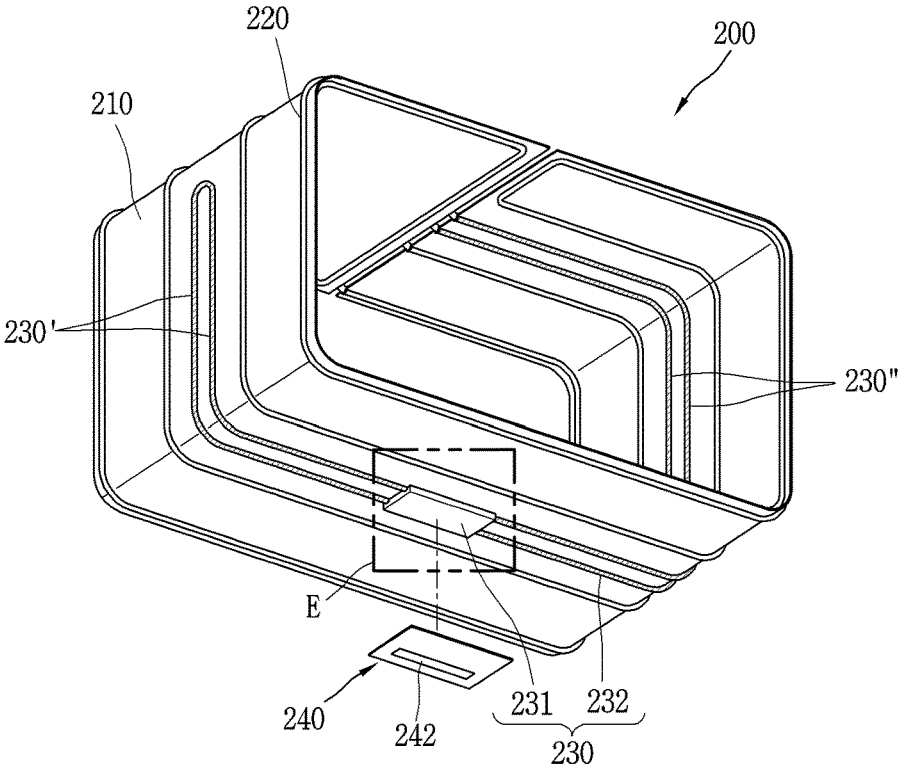
Figure 12:
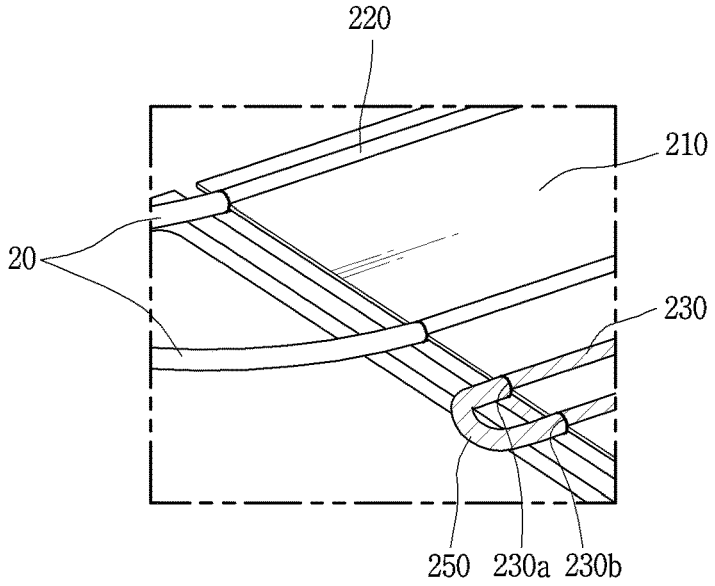
FIG. 12 is an enlarged view of a portion 'D' of FIG. 10.

FIGS. 10 and 11 are conceptual views illustrating a second example of an evaporator 200 applied to the refrigerator 10 of FIG. 1, viewed from different directions, and FIG. 12 is an enlarged view illustrating a portion 'D' of FIG. 10.

Referring to FIGS. 10 through 12, a cooling tube 220 is formed on a case 210 in a preset pattern and refrigerant (R) for cooling is filled therein. A heating tube 230 is formed on the case 210 in a preset pattern so as not to be overlapped with the cooling tube 220 and working fluid (W) for defrosting is filled therein.

In the evaporator 200 according to this embodiment, the formation position of the cooling tube 220 and the heating tube 230 is opposite to that of the preceding embodiment. As shown, the cooling tube 220 is formed to cover at least part of the heating tube 230. That is, the heating tube 230 is formed within a loop type cooling flow path 220' which is formed by the cooling tube 230.

A heating unit 240 is fixed to an external surface of the case 210 which corresponds to the heating tube 230 so as to heat the working fluid (W) within the heating tube 230. In this embodiment, there is shown that the heating unit 240 is fixed to a lower portion of a bottom surface of the case 210.

As described in the preceding embodiment, the heating tube 230 includes a chamber 231 and a flow tube 232. The chamber 131 is formed at a position that is spaced from an edge of the case 210 toward the inside, and the cooling tube 220 is disposed at both sides of the chamber 131. In order to effectively use heat of high temperature at the heating unit 240 and the chamber 231, the chamber 231 may be disposed at a center of a bottom surface of the case 210.

The flow tube 232 may be formed extendedly along at least one surface of the case 210. In this embodiment, there is shown that the flow tube 232 is formed extendedly at both sides of the bottom surface of the case 210. The flow tube 232 may be formed extendedly up to an upper surface of the case 210. Here, at the flow tube 232 which is formed extendedly up to the upper surface of the case 210, first and second openings 230*a* and 230*b* may be formed, and the first and second openings 230*a* and 230*b* may be coupled to each other by a coupling member 250, as described in the preceding embodiment.

The flow tube 232 is coupled to an inlet and an outlet of the chamber 231, respectively, and forms a heating flow path in which working fluid (W) of high temperature flows and the cooled working fluid (W) is collected to the chamber 231.

As described in the preceding embodiments, the chamber 231 includes one outlet and one inlet, and both ends of the flow tube 232 are coupled to the outlet and inlet, respectively, to form a single flow path for circulating the working fluid (W).

Otherwise, as shown in this embodiment, the outlet may be formed as a first outlet 231*a*' and a second outlet 123*a*", respectively, which are disposed at both sides of the chamber 231, and the inlet may be formed as a first inlet 231*b*' and a second inlet 231*b*" which are disposed at both sides of the chamber 231, respectively. That is, at one side of the chamber 231, the first outlet 231*a*' and the first inlet 231*b*' may be disposed, respectively, and at the other side of the chamber 231, the second outlet 231*a*" and the second inlet 231*b*" may be disposed, respectively.

In the above configuration, the flow tube 232 forms a first heating flow path 230' through which the working fluid (W) is discharged from the first outlet 231*a*' to be collected to the first inlet 231*b*', and a second heating flow path 230" through which the working fluid (W) is discharged to the second outlet 231*a*" to be collected to the second inlet 231*b*".

Specifically, part of the flow tube 232 is coupled to the first outlet 231*a*' and extendedly formed at one side of the case 210 so as to be far from the chamber 231, then extendedly formed so as to get near to the chamber 231, and thereafter coupled to the first inlet 231*b*'. Part of the flow tube 232 forms the first heating flow path 230'. In addition, another part of the flow tube 232 is coupled to the second outlet 231*a*" and extendedly formed at another side of the case 210 so as to be far from the chamber 231, then extendedly formed so as to get near to the chamber 231, and thereafter coupled to the second inlet 231*b*". Part of the flow tube 232 forms the second heating flow path 230".

Hereinafter, a configuration related to defrosting of the evaporator 200 will be more specifically described.

Figure 13:
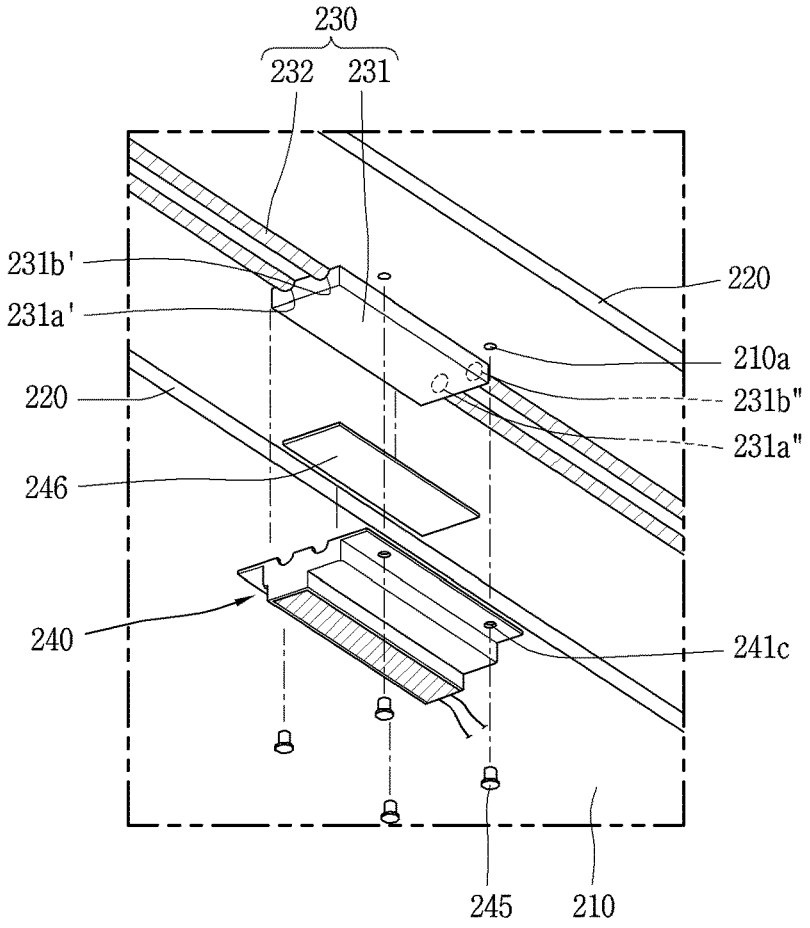
FIG. 13 is an enlarged view of a portion 'E' of FIG. 11.
Figure 14:
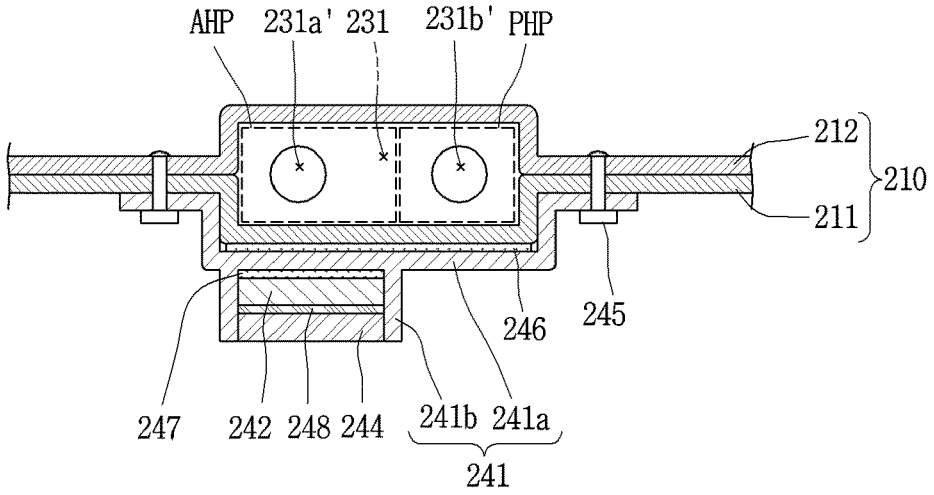
FIG. 14 is a sectional view taken along line "F-F" in FIG. 10.
Figure 15:
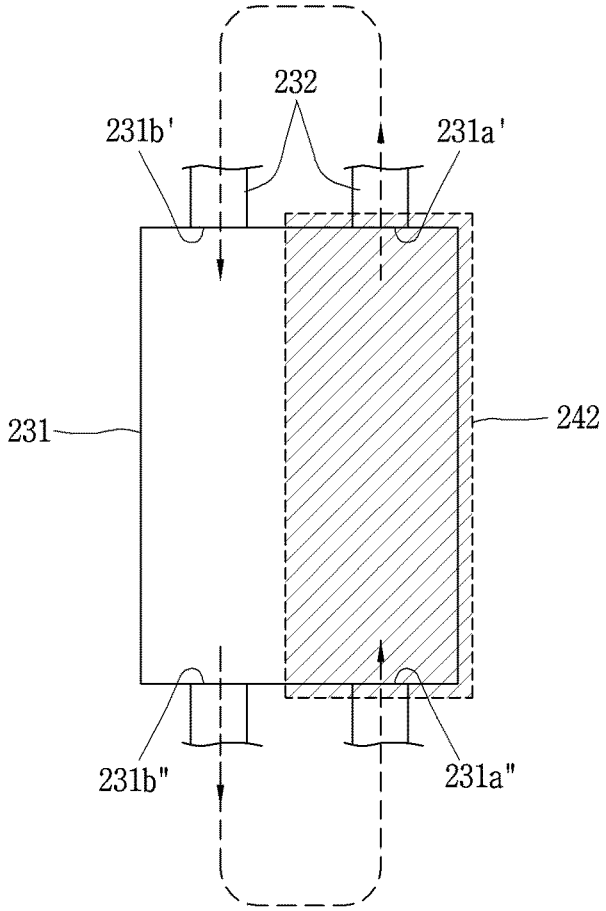
FIG. 15 is a conceptual view for explaining an installation position of a heater within a chamber of FIG. 11.

FIG. 13 is an enlarged view of a portion 'E' of FIG. 11, FIG. 14 is a sectional view taken along line "F-F" in FIG. 10, and FIG. 15 is a conceptual view illustrating an installation position of a heater 242 within the chamber 231 of FIG. 11.

Referring to FIGS. 13 through 15 and the preceding drawings, the heating unit 240 is fixed to an external surface of the case 210 corresponding to the chamber 231 so as to heat working fluid (W) within the heating tube 230. The heating unit 240 includes a mounting frame 241, a heater 242, a lead wire 243 and a sealing member 244.

The chamber 231 is divided into an active heating part (AHP) which corresponds to a portion where the heater 242 is disposed and a passive heating part (PHP) which corresponds to a portion where the heater 242 is not disposed.

The active heating part (AHP) may be positioned to correspond to first and second outlets 231*a*' and 231*a*" of the chamber 231. For instance, the first and second outlets 231*a*' and 231*a*" of the chamber 231 may be disposed within the active heating part (AHP).

In this embodiment, there is exemplified shown that the heater 242 is not disposed at the first and second inlets 231*b*' and 231*b*" of the chamber 231, but disposed to correspond to the first and second outlets 231*a*' and 231*a*" of the chamber 231. The heater 242 may be disposed so as to cover the first and second outlets 231*a*' and 231*a*" and the flow tube 232 extended from the first and second outlets 231*a*' and 231*a*". In this configuration, the first and second outlets 231*a*' and 231*a*" of the chamber 231 are disposed within the active heating part (AHP).

The passive heating part (PHP) may be disposed so as to correspond to the first and second outlets 231*a*' and 231*a*" of the chamber 231. In this configuration, working fluid (W) which returns after moving in the flow path 232 is not directly introduced into the active heating part (AHP) so that a backflow of the working fluid (W) due to reheating is prevented.

In this embodiment, there is shown that the first and second inlets 231*b*1 and 231*b*" of the chamber 231 are disposed within the passive heating part (PHP) so that working fluid (W) which returns after moving in the flow tube 232 is introduced into the passive heating part (PHP). That is, the first and second inlets 231*b*' and 231*b*" of the chamber 231 are formed at a portion where the heater 242 is not disposed.

Further, in this embodiment, there is shown that the heater 242 is not disposed along a direction that the flow tube 232 which is coupled to the first and second inlets 231*b*' and 231*b*" of the chamber 231 is extended. According to this embodiment, the returning working fluid (W) is not heated by the heater 242 when flowing in the chamber 231, but when the returned working fluid (W) flows in the active heating part (AHP) while forming an eddy flow within the chamber 231, the returned working flow (W) is reheated by the heater 242 and then discharged toward the first and second outlets 231*a*' and 231*a*".

The protrusion portion 241*b* of the mounting frame 241 is configured to form a recessed space 241*b*' at a position which corresponds to the active heating part (AHP). As a result, when mounting the mounting frame 241 to the case 210, the heater 242 installed to the recessed space 241*b*' is disposed to correspond to a position which is out of the first and second inlets 231*b*' and 231*b*" of the chamber 231. By such an arrangement, the portion corresponding to the first and second inlets 231*b*' and 231*b*" of the chamber 231 forms the active heating part (AHP).

Described hereinbefore are a configuration that the cooling tube 120 is enclosed by the heating tube 130 and a configuration that the heating tube 130 is enclosed by the cooling tube 120 in connection with the evaporator according to the present disclosure in which the cooling tube and heating tube are formed on the case in a roll bond type, but the present disclosure is not limited thereto. The cooling tube may be formed at one side of the case, and the heating tube may be formed at another side of the case, and other various types of configurations may be considered.

Hereinafter, will be described a new type of evaporator 300 in which a heat pipe 330 for defrosting is mounted to a case 310 on which a cooling tube 320 is formed in a roll bond type.

Figure 16:
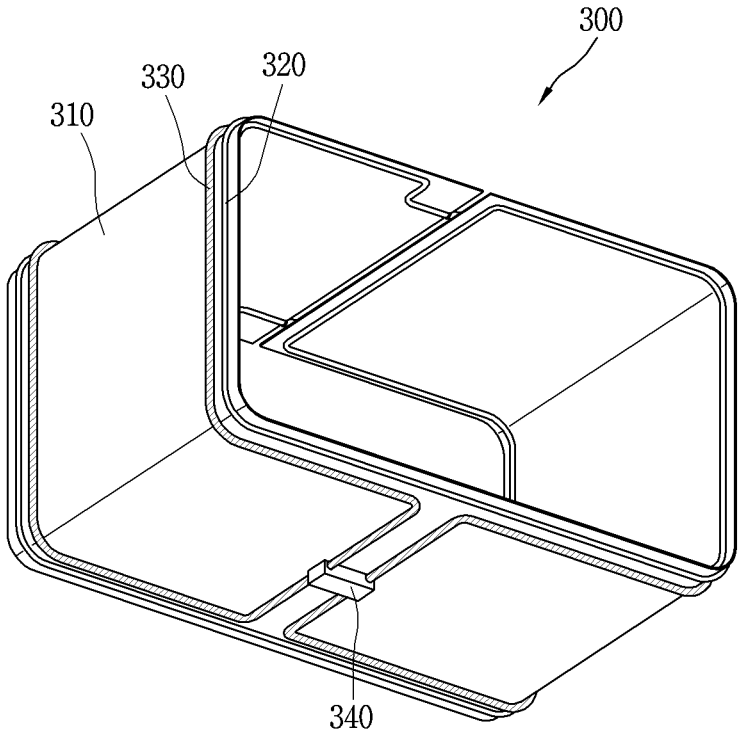
FIG. 16 is a conceptual view illustrating a third example of the evaporator applied to the refrigerator of FIG. 1.
Figure 17:
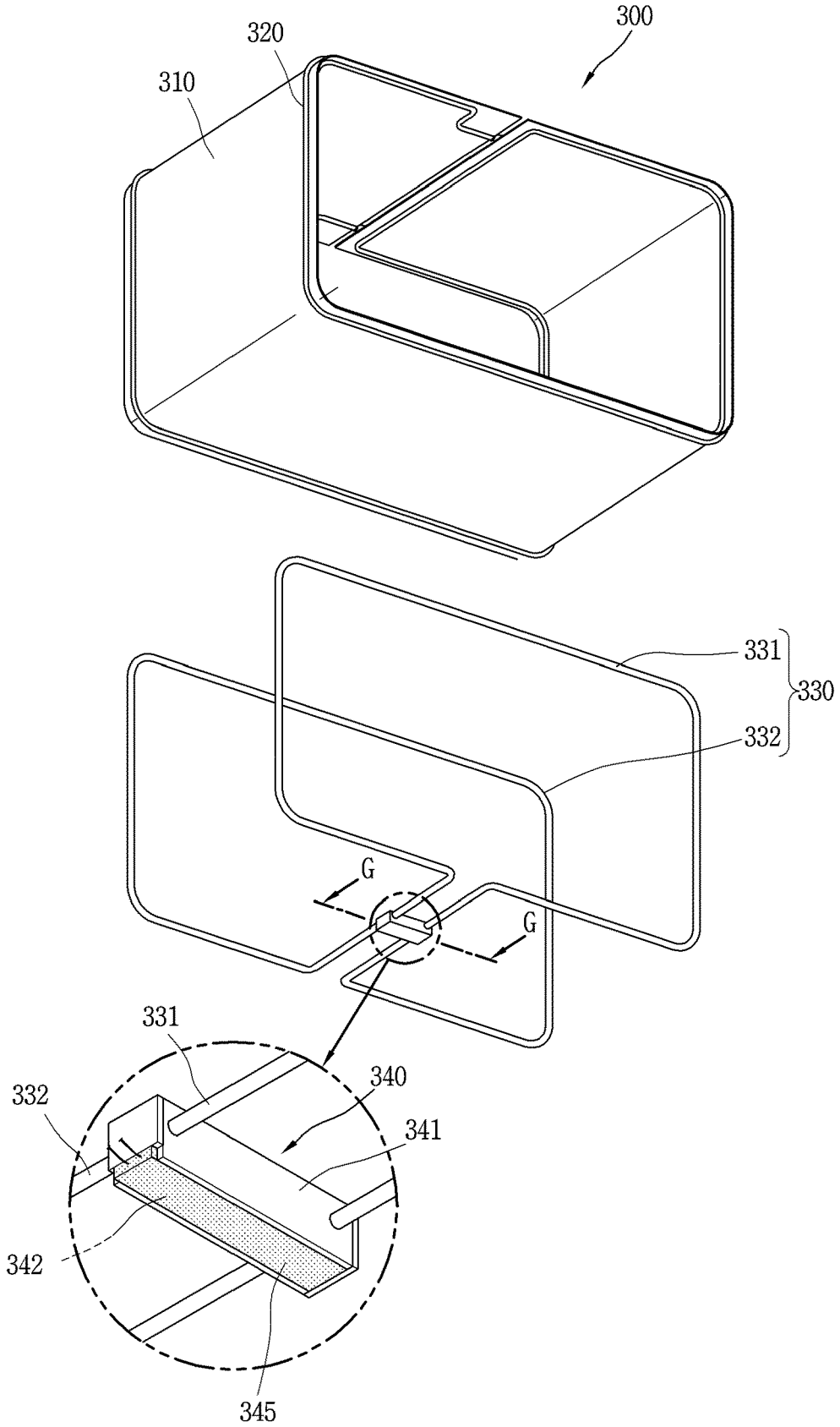
FIG. 17 is a disassembled perspective view illustrating the evaporator of FIG. 16.

FIG. 16 is a conceptual view illustrating a third example of the evaporator 300 applied to the refrigerator 10 of FIG. 1, and FIG. 17 is a disassembled perspective view illustrating the evaporator 300 of FIG. 16.

Referring to FIGS. 16 and 17, the evaporator 300 includes a case 310, a cooling tube 320, a heating unit 340, and a heat pipe 330. In this embodiment, there is provided a configuration that a defrosting device including the heating unit 340 and the heat pipe 330 is mounted to the evaporator in which the cooling tube 320 is formed on the case 310 in a roll bond type. Accordingly, unlike the preceding embodiments, the evaporator 300 according to this embodiment has an advantage in view of design in that the heat pipe 330 can be disposed without considering overlapping with the cooling tube 320.

Explanations of the case 310 and the cooling tube 320 will be replaced by those in the first embodiment.

Hereinafter, the defrosting device including the heating unit 340 and the heat pipe 330 will be described.

The heating unit 340 is provided outside the case 310 and electrically coupled to a controller to generate heat when receiving a drive signal from the controller. For instance, the controller may be configured to apply a drive signal to the heating unit at every preset time interval, or apply a drive signal to the heating unit when a sensed temperature in the refrigerating chamber 11*a* or the freezing chamber 11*b* is lower than a preset temperature.

The heat pipe 330 is coupled to the heating unit 340 and forms a closed loop type heating flow path 330' through which the working fluid (W) flows together with the heating unit 340.

As shown, both ends of the heat pipe 330 are coupled to outlets 341*a*' and 341*a*" and inlets 341*b*' and 341*b*" of the heating unit 340, respectively, and the heat pipe 330 is disposed to enclose the case 310 so that heat of high temperature is radiated to the case 310 by the working fluid (W) which is heated by the heating unit 340 and transferred. The heat pipe 330 may be formed of an aluminum material.

The heat pipe 330 may be configured as a single heat pipe to form a single row, or may include first and second heat pipes 331 and 332 which are disposed at front and rear sides of the evaporator 300 in two rows.

In this embodiment, there is shown that the first heat pipe 331 is disposed at the front side of the case 310 and the second heat pipe 331 is disposed at the rear side of the case 310 in two rows, based on the drawings.

Figure 18:
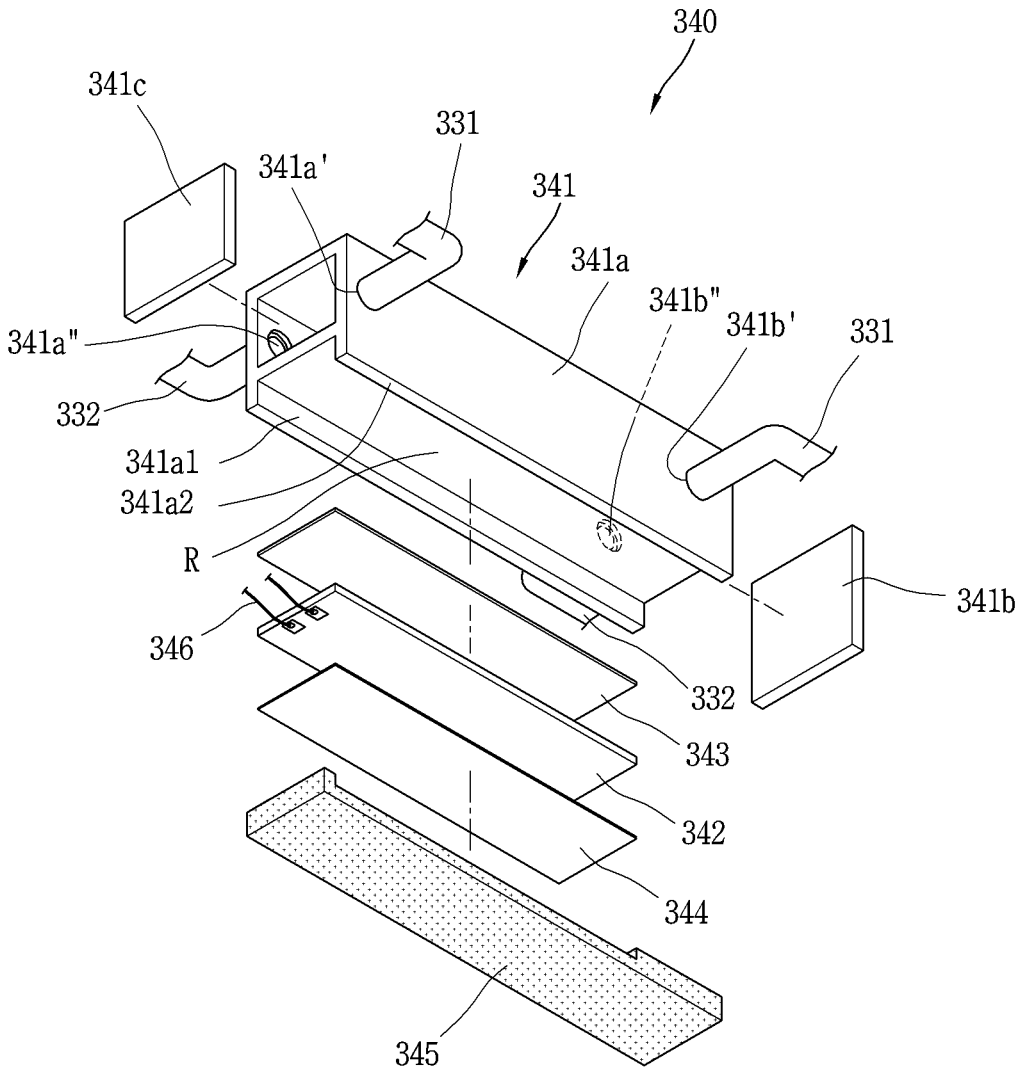
FIG. 18 is a disassembled perspective view illustrating a heating unit of FIG. 17.
Figure 19:
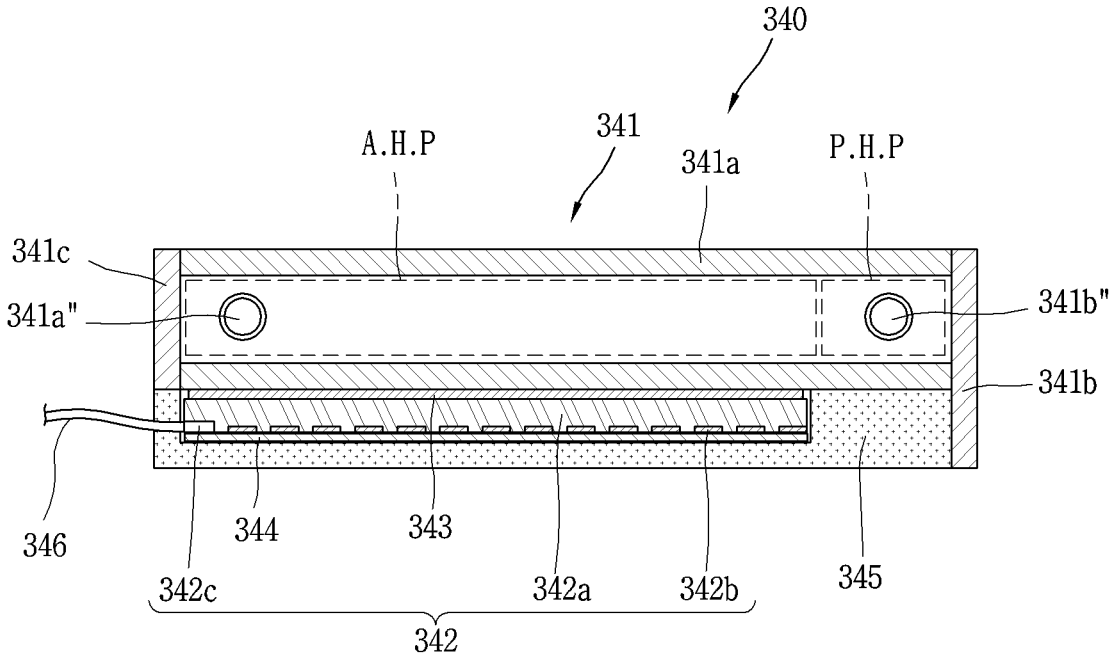
FIG. 19 is a sectional view of the heating unit of FIG. 17 taken along line "G-G" in FIG. 17.

FIG. 18 is a disassembled perspective view illustrating the heating unit 340 of FIG. 17, and FIG. 19 is a sectional view of the heating unit 340 of FIG. 17 taken along line "G-G" in FIG. 17.

Referring to FIGS. 18 and 19 and the preceding drawings, the heating unit 340 includes a heater case 341 and a heater 342.

The heater case 341 formed in a hollow shape is coupled to both ends of the heat pipe 330 and forms a closed loop type heating flow path 330', together with the heat pipe 330, through which working fluid (W) circulates. The heater case 341 may be formed in a rectangular column shape and formed of an aluminum material.

The heater case 341 is disposed at a lower portion of the case 310. For instance, the heater case 341 may be disposed at a lower part of a bottom surface of the case 310, or a lower part of one side surface of the case 310.

At both ends of the heater case 341 in a lengthwise direction, outlets 341*a*' and 341*a*" and inlets 341*b*' and 341*b*", which are coupled to both ends of the heat pipe 330, are formed, respectively.

Specifically, at one side (for instance, front end) of the heater case 341, outlets 341*a*' and 341*a*", which are coupled with one end of the heat pipe 330, are formed. The outlets 341*a*' and 341*a*" mean an opening through which working fluid (W) heated by the heater 342 is discharged to the heat pipe 330.

At another side (for instance, rear end) of the heater case 341, inlets 341*b*' and 341*b*", which are coupled with another end of the heat pipe 330, are formed. The inlets 341*b*' and 341*b*" mean an opening through which working fluid (W) condensed while passing through the heater 342 is collected to the heater case 341.

The heater 342 is fixed to an external surface of the heater case 341 and configured to generate heat when receiving a drive signal from a controller. The working fluid (W) within the heater case 341 is heated at a high temperature by receiving heat from the heater 342.

The heater 342 is fixed to an external surface of the heater case 341 and extendedly formed in one direction along a lengthwise direction of the heater case 341. As for the heater 342, a plate shaped heater (for instance, a plate shaped ceramic heater) is used.

In this embodiment, there is shown that the heater case 341 is formed as a rectangular shaped pipe having an inside empty space of a rectangular section, and the plate shape heater 342 is fixed to a lower surface of the heater case 341. In such a configuration that the heater 342 is fixed to a lower surface of the heater case 341, it is advantageous to generate an ascending force of the heated working fluid (W), and defrost water generated by defrosting does not directly drop onto the heater 342, resulting in preventing a short circuit.

Referring to FIG. 19, at a base frame 342*a* of the heater 342, a heating element 342*b* is formed so as to generate heat when a power is supplied. Explanations of the heater 342 will be replaced by those in the first embodiment.

The heat pipe 330 and the heater case 341 may be formed of the same material (for instance, an aluminum material), and in this instance, the heat pipe 330 may be directly coupled to the outlets 341*a*' and 341*a*" and the inlets 341*b*' and 341*b*".

For reference, in a case where the heater 342 is formed in a cartridge type and mounted within the heater case 341, the heater case 341 made of copper not aluminum is used for welding and sealing between the heater 342 and the heater case 341.

When the heat pipe 330 and the heater case 341 are made of different materials (as in the above case that the heat pipe 330 is made of aluminum and the heater case 341 is made of copper), it is difficult to directly fix the heat pipe 330 to the outlets 341*a*' and 341*a*" and the inlets 341*b*' and 341*b*" of the heater case 341. Thus, to fix those elements, an outlet pipe is extendedly formed at the outlets 341*a*' and 341*a*" of the heater case 341 and a collection pipe is extendedly formed at the inlets 341*b*' and 341*b*" of the heater case 341, and then the heat pipe 330 is coupled to the outlet pipe and the collection pipe. In this process, welding and sealing steps are required.

And in the configuration that the heater 341 is fixed to an external surface of the heater case 341, according to the present invention, since the heater case 341 and the heat pipe 330 can be made of the same material, the heat pipe 330 can be directly coupled to the outlets 341*a*' and 341*a*" and the inlets 341*b*' and 341*b*" of the heater case 341.

Meanwhile, as the working fluid (W) filled in the heater case 341 is heated at a high temperature, the working fluid (W) flows and moves in the heat pipe 330 due to a pressure difference. Specifically, the high temperature working fluid (W), which has been heated by the heater 342 and discharged to the outlets 341*a*' and 341*a*", transfers heat to the case 310 while moving through the heat pipe 330. The working fluid (W) is gradually cooled while undergoing such a heat exchange process, and is introduced into the inlets 341*b*' and 341*b*" of the heater case 341. The cooled working fluid (W) is reheated by the heater 342 and discharged to the outlets 341*a*' and 341*a*", and the above process is repeatedly executed. By such a circulation process, defrosting of the case 310 is executed.

In the configuration that the heat pipe 330 includes the first and second heat pipes 331 and 332, the first and second heat pipes 331 and 332 are coupled to the inlets 341*b*' and 341*b*" and the outlets 341*a*' and 341*a*" of the heater case 341, respectively.

Specifically, the outlets 341*a*' and 341*a*" of the heater case 341 include a first outlet 341*a*' and a second outlet 341*a*", and one ends of the first and second heat pipes 331 and 332 are coupled to the outlets 341*a*' and 341*a*", respectively. By such an arrangement, the working fluid (W) in a gas state which is heated by the heating unit 340 is discharged to the first and second heat pipes 331 and 332 through the first and second outlets 341*a*' and 341*a*", respectively.

The first and second outlets 341*a*' and 341*a*" may be formed at external surfaces of both sides of the heater case 341, or at a front end of the heater case 341 side by side.

One ends of the first and second heat pipes 331 and 332 coupled to the first and second outlets 341*a*' and 341*a*", respectively, may be comprehended as first and second flow-in parts, for their function (portions in which the high temperature working fluid (W) which is heated by the heater 342 flows).

Further, the inlets 341*b*' and 341*b*" of the heating unit 340 include a first inlet 341*b*' and a second inlet 341*b*", and another ends of the first and second heat pipes 331 and 332 are coupled to the first and second inlets 341*b*' and 341*b*", respectively. By such an arrangement, the working fluid (W) in a liquid state which is cooled while moving through the heat pipe 330 is introduced into the heater case 341 through the first and second inlets 341*b*' and 341*b*", respectively.

The first and second inlets 341*b*' and 341*b*" may be formed at external surfaces of both sides of the heater case 341, or at a rear end of the heater case 341 side by side.

Another ends of the first and second heat pipes 331 and 332 coupled to the first and second inlets 341*b*' and 341*b*", respectively, may be comprehended as the first and second returning parts, for their function (portions through which the working fluid (W) which is cooled while moving through the heat pipes 331 and 332 in a liquid state returns).

Meanwhile, as shown, the outlets 341*a*' and 341*a*" of the heater case 341 may be formed at a portion which is spaced apart from a front end to a rear end of the heater case 341 at a predetermined gap. That is, the front end of the heater case 341 may be interpreted as a protrusion formed forwardly after passing through the outlets 341*a*' and 341*a*".

The heater 342 may be extendedly formed at a position from a spot between the inlets 341*b*' and 341*b*" and the outlets 341*a*' and 341*a*" to a position which has passed through the outlets 341*a*' and 341*a*".

According to this, the outlets 341*a*' and 341*a*" of the heater case 341 are located within the active heating part (AHP).

By the above described configuration, part of the working fluid (W) stays at a front end of the heater case 341 (a space between an inner front end of the heater case 341 and the outlets 341*a*' and 341*a*") to prevent an overheating of the heater 342.

Specifically, the working fluid (W) which has been heated at the active heating part (AHP) is moved along a circulation direction, that is, moved toward a front end of the heater case 341, and in this process, part of the working fluid (W) is discharged through the diverged outlets 341*a*' and 341*a*", but the remaining working fluid stays at a front end of the heater case 341 after passing through the outlets 341*a*' and 341*a*", while generating an eddy flow.

As described above, since the whole quantity of the heated working fluid (W) is not directly discharged through the outlets 341*a*' and 341*a*", but part of thereof stays within the heater case 341, overheating of the heater 342 can be prevented.

Meanwhile, the heater case 341 is divided into an active heating part (AHP) which corresponds to a portion where the heater 342 is disposed, and a passive heating part (PHP) which corresponds to a portion where the heater 34 is not disposed.

The active heating part (AHP) is a portion which is directly heated by the heater 342, and the working fluid (W) in a liquid state is heated at the active heating part (AHP) to have a phase change into gas of high temperature.

The outlets 341*a*' and 341*a*" of the heater case 341 may be located within the active heating part (AHP), or in front of the active heating part (AHP). In FIG. 19, there is exemplified shown that the heater 342 is extendedly formed forwardly after passing through regions below the outlets 341*a*' and 341*a*" which are formed at the external surfaces of both sides of the heater case 341. That is, in this embodiment, the outlets 341*a*' and 341*a*" of the heater case 341 are located within the active heating part (AHP).

At the rear side of the active heating part (AHP), the passive heating part (PHP) is formed. The passive heating part (PHP) is not directly heated by the heater 341 unlike the active heating part (AHP), but indirectly heated to a predetermined temperature. Here, the passive heating part (PHP) may cause the temperature to rise at the working fluid (W) in a liquid state to a predetermined level, but does not have a high temperature enough to phase-change the working fluid (W) into gas. That is, from a viewpoint of temperature, the active heating part (AHP) forms a high temperature part and the passive heating part (PHP) forms a low temperature part, relatively.

If it is configured that the working fluid (W) is made to directly return to the active heating part (AHP) of high temperature, the collected working fluid (W) is reheated not to smoothly return to the heater case 341 but to backflow. This may disturb a circulation flow of the working fluid (W) within the heat pipe 330, thereby causing an overheating of the heater 342.

To solve such a problem, the inlets 341*b*' and 341*b*" of the heating unit 340 are formed within the passive heating part (PHP) so that the working fluid (W) which returns after moving through the heat pipe 330 may not be directly introduced into the active heating part (AHP).

In this embodiment, there is shown that the inlets 341*b*' and 341*b*" of the heating unit 340 are located within the passive heating part (PHP) so that the working fluid (W) which returns after moving through the heat pipe 330 may be introduced into the passive heating part (PHP). That is, the inlets 341*b*' and 341*b*" of the heating unit 340 are formed at a position where the heater 342 is not disposed within the heater case 341.

Hereinafter, a detailed structure of the heater case 341 and a coupling structure of the heater case and the heater 342 will be described in detail.

The heater case 341 includes a main case 341*a*, and a first cover 341*b* and a second cover 341*c* which are coupled to both sides of the main cover 341*a*.

The main cover 341*a* has an empty space inside and opened ends. The main case 341*a* may be formed of an aluminum material. In FIG. 18, there is shown that the main case 341*a* is formed in a rectangular column shape and extended long along one direction.

The first and second covers 341*b* and 341*c* are coupled to both ends of the main body 341*a* so as to cover both of the opened ends. The first and second covers 341*b* and 341*c* may be formed of an aluminum material which is the same material as that of the main body 341*a*.

In this embodiment, the outlets 341*a*' and 341*a*" and the inlets 341*b*' and 341*b*" are provided at positions spaced apart from each other along a longitudinal direction of the main case 341*a*, and both ends of the heat pipes 331 and 332 (flow-in parts coupled to the outlets 341*a*' and 341*a*" and return parts coupled to the inlets 341*b*' and 341*b*") are coupled to the outlets 341*a*' and 341*a*" and the inlets 341*b*' and 341*b*", respectively.

More specifically, at one side surface of the main case 341*a*, the first outlet 341*a*' and the first inlet 341*b* are formed to be spaced apart from each other along a longitudinal direction, and at the other side surface which is opposite to the one side surface, the second outlet 341*a*" and the second inlet 341*b*" are formed to be spaced apart from each other along a longitudinal direction. Here, the first outlet 341*a*' and the second outlet 341*a*" may be disposed to be opposite to each other, and the first inlet 341*b*' and the second inlet 341*b*" may be disposed to be opposite to each other.

However, the present disclosure is not limited to this. At least one of the inlets 341*b*' and 341*b*" and the outlets 341*a*' and 341*a*" may be formed at the first and/or the second cover 341*b* and/or 341*c*.

Meanwhile, since the heating unit 340 is formed at a lower portion of the case 310, frost water which is generated by defrosting may flow ontp the heating unit 340, due to the structure. Since the heater 342 which is included in the heating unit 340 is an electronic component, a short circuit may occur when the heater 342 is in contact with the defrost water.

To prevent moisture including the defrost water from being infiltrated into the heater 341, the heating unit 340 according to the present disclosure may include a sealing structure as below.

First, the heater 341 is fixed to a bottom surface of the main case 341*a*, and at both sides of the main case 341, first and second extension fins 341*a*1 and 341*a*2 are extendedly formed from the bottom surface toward a lower side so as to cover side surfaces of the heater 342 which is fixed to the bottom surface. By such a configuration, even when defrost water which is generated by a defrosting operation drops on the main case 341*a* and falls down along an external surface of the main case 341*a*, the frost water can not be infiltrated into the heater 342 which is contained within the first and second extension fins 341*a*1 and 341*a*2.

Further, the sealing member 345 may fill a recessed space formed by a rear surface of the heater 342 and the first and second extension fins 341*a*1 and 341*a*2 so as to cover the heater 342. As for the sealing member 345, silicon, urethane, epoxy, and the like may be used. For instance, liquefied epoxy is used to fill the recessed space to cover the heater 342 and after the liquefied epoxy is hardened, the sealing structure of the heater 342 may be completed. In this instance, the first and second extension fins 341*a*1 and 341*a*2 function as side walls for defining the recessed space in which the sealing member 345 is inserted (contained).

Between the rear surface of the heater 342 and the sealing member 345, an insulation member 344 may be interposed. As for the insulation member 344, mica sheet made of a mica material may be used. By disposing the insulation member 344 at the rear surface of the heater, heat transfer to the rear surface of the heater 342 may be limited when the heating element 342*b* generates heat upon applying a power.

Moreover, between the main case 341*a* and the heater 342, a heat-conductive adhesive 343 may be interposed. The heat-conductive adhesive 343 is configured to fix the heater 342 to the main case 341*a* and to transfer heat generated by the heater 342 to the main case 341*a*. As for the heat-conductive adhesive 343, heat-resistant silicon which can endure a high temperature may be used.

Meanwhile, at least one of the first and second covers 341*b* and 341*c* may be extendedly formed downwardly from a bottom surface of the main case 341*a* to cover the heater 342 together with the first and second extension fins 341*a*1 and 341*a*2. According to this configuration, filling of the sealing member 343 may be more effectively executed.

However, considering that the lead wire 346 connected to the terminal 342*c* of the heater 342 is extended from one side of the heater case 341 to the outside, one cover corresponding to one side of the heater case 341 between the first and second covers 341*b* and 341*c* is not formed to be extended downwardly, or may include a recess or a hole through which the lead wire 346 may pass, even it is extendedly formed downwardly.

In this embodiment, there is shown that the second cover 341*c* is extendedly formed downwardly from a bottom surface of the main case 341*a*, and the lead wire 346 is extendedly formed toward the first cover 341*b*.

Figure 20:
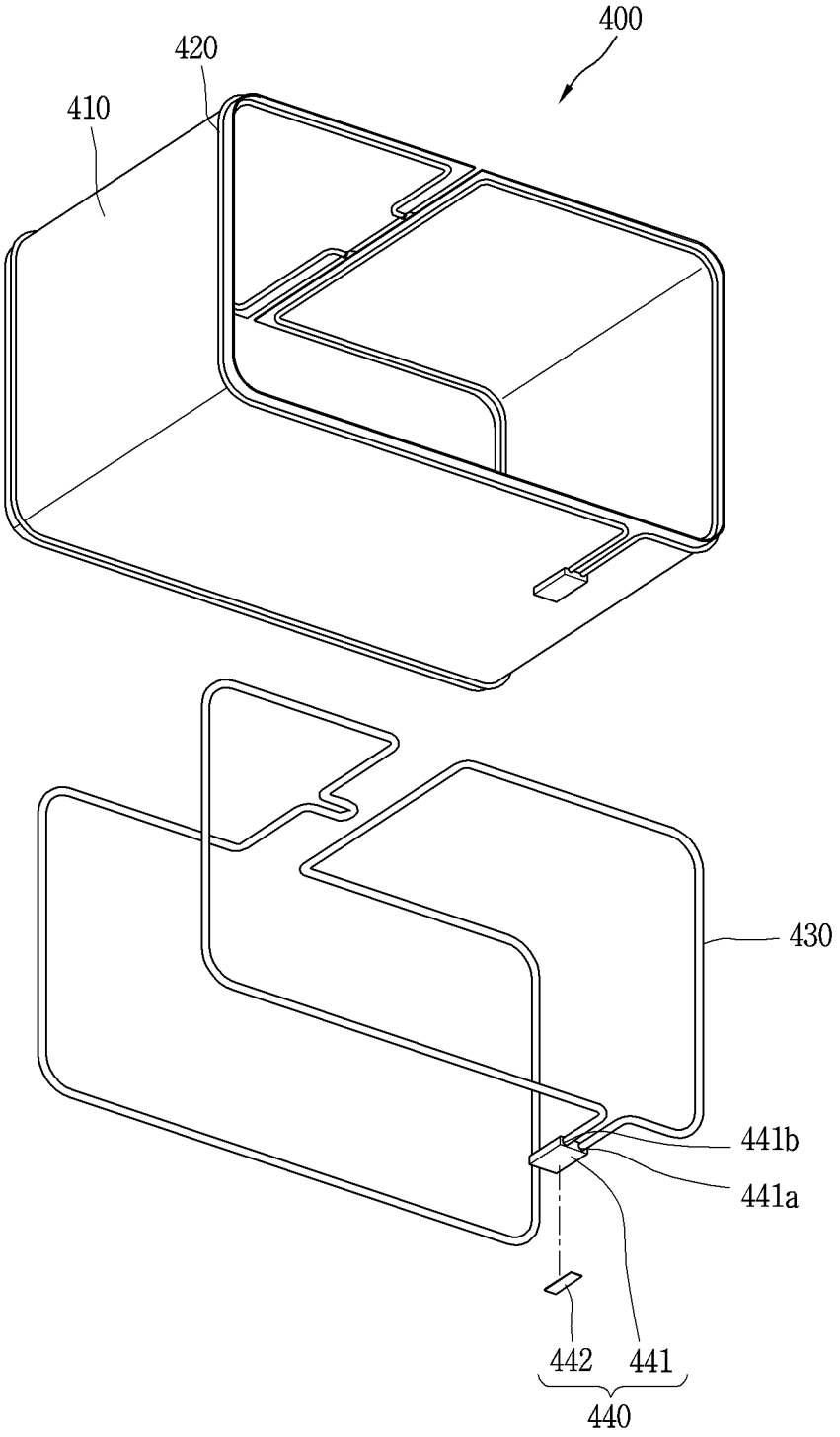
FIGS. 20 and 21 are conceptual views illustrating a modified example of a third embodiment.
Figure 21:
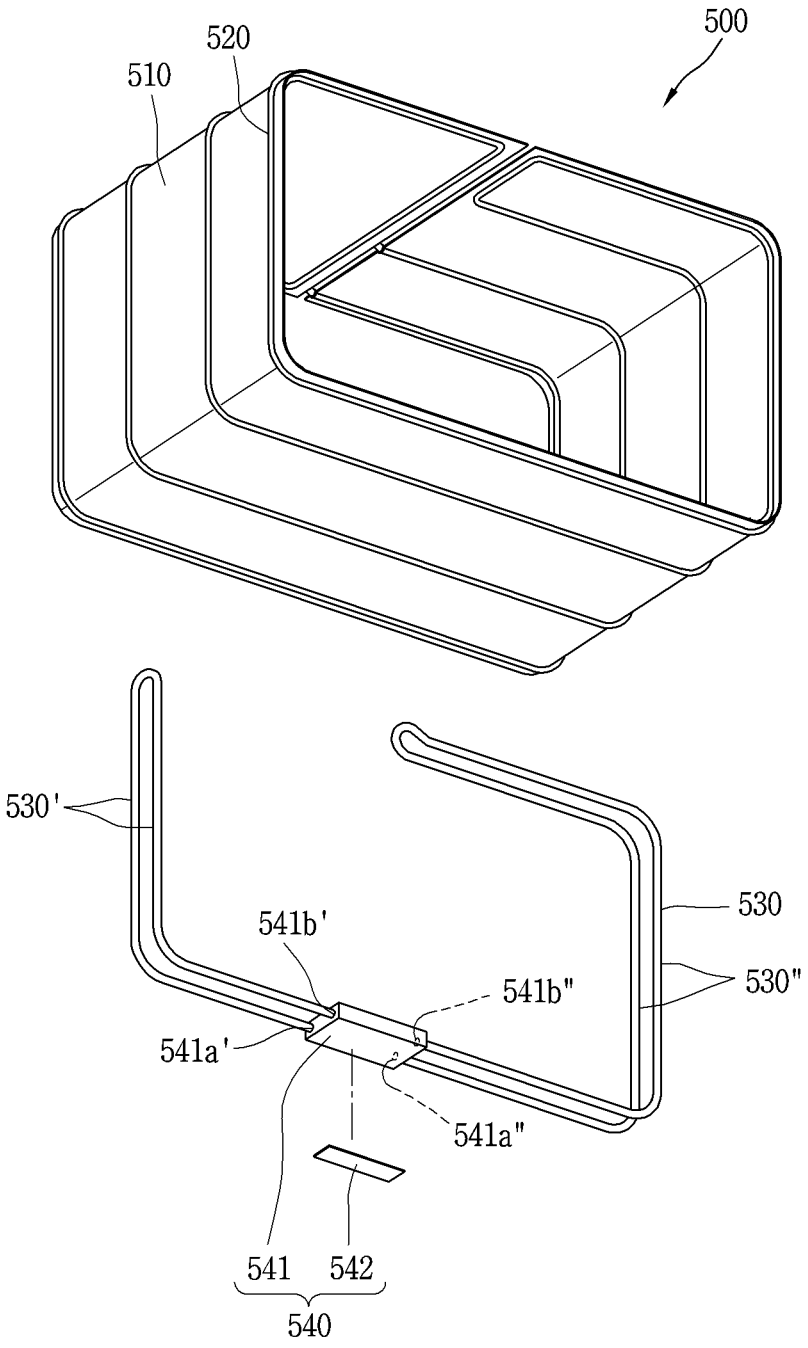

FIGS. 20 and 21 are conceptual views illustrating a modified example of the third example, in which heating units 440 and 540 are schematically shown, for reference. As for the heating units 440 and 540, the heating unit 340 of the third embodiment may be applied.

Referring first to FIG. 20, a heating flow path formed by a heat pipe 430 of this embodiment may have a configuration corresponding to the flow path formed by the heating tube 130 of the first embodiment.

Specifically, a heater case 441 includes one outlet 441*a* and one inlet 441*b*. One end of the heat pipe 430 is coupled to the outlet 441*a* and the other end of the heat pipe 430 is coupled to the inlet 441*b*.

The heat pipe 430 may be formed to be extended along an edge of the case 410. In the drawing, there is shown a configuration that the heater case 441 is disposed at a lower part of a bottom surface of the case 410, and the heat pipe 430 coupled to the outlet 441*a* of the heater case 441 is extended upwardly along one side surface of the case 410 and then is extended downwardly, and then coupled to the inlet 441*b*, after being extended upwardly and then downwardly along the other side surface of the case 410 through the bottom surface of the case 410.

In the drawing, a flowing direction of the working fluid (W) which flows in the heat pipe 430 formed at a front side of the case 410 is opposite to that of the working fluid (W) which flows in the heat pipe 430 formed at a rear side of the case 410.

Next, referring to FIG. 21, heating flow paths 530' and 530" formed by the heat pipe 530 according to this embodiment may have the same configuration as that formed by the heating tube 230 of the second embodiment.

Specifically, a heater case 541 includes two outlets 541*a*' and 541*a*" and two inlets 541*b*' and 541*b*". As shown, the outlets 541*a*' and 541*a*" may be formed as a first outlet 541*a*' and a second outlet 541*a*" separately formed at both sides of the heater case 541, and the inlets 541*b*' and 541*b*" may be formed as a first inlet 541*b*' and a second inlet 541*b*" separately formed at both sides of the heater case 541, respectively. That is, at one side of the heater case 541, the first outlet 541*a*' and the first inlet 541*b*' may be provided, respectively, and at another side of the heater case 541, the second outlet 541*a*" and the second inlet 541*b*" may be provided, respectively.

In the above configuration, the heat pipe 530 forms a first heating flow path 530' in which working fluid (W) is discharged from the first outlet 541*a*' to be collected to the first inlet 541*b*', and a second heating flow path 530" in which working fluid (W) is discharged to the second outlet 541*a*" to be collected to the second inlet 541*b*"

Specifically, one part of the heat pipe 530 is coupled to the first outlet 541*a*', formed extendedly toward one side of the case 510 so as to be distant from the heater case 541, and formed extendedly so as to get near to the heater case 541 and then coupled to the first inlet 541*b*'. Such one part of the heat pipe 530 forms the first heating flow path 530'. In addition, another part of the heat pipe 530 is coupled to the second outlet 541*a*", formed extendedly toward another side of the case 510 so as to be distant from the heater case 541, and formed extendedly so as to get near to the heater case 541 and then coupled to the second inlet 541*b*". Such another part of the heat pipe 530 forms the second heating flow path 530".

The invention claimed is:

1. An evaporator comprising:

a case having a box shape comprising a first case sheet and a second case sheet that are coupled to each other to define a metal frame, the metal frame being bent to define a storage chamber in the case; a cooling tube that is disposed at the case, that has a first preset pattern, and that is configured to carry refrigerant for cooling; a heating tube that is disposed at the case, that has a second preset pattern disposed outside of the first preset pattern, and that is configured to carry working fluid for defrosting the case; and a heating unit comprising a heater configured to generate heat and fixed to an external surface of the case at a position corresponding to the heating tube, the heater being configured to heat working fluid within the heating tube, wherein the heating unit is fixed to a lower surface of the case, and is configured to generate an ascending force of the working fluid within the heating tube, wherein each of the cooling tube and the heating tube includes a space that is defined between the first case sheet and the second case sheet and that extends along the first case sheet and the second case sheet, wherein the chamber that is configured to receive working fluid is disposed at a bottom surface of the case or at a lower portion of one side surface of the case, wherein a cross-sectional area of an outlet of the chamber is greater than or equal to a cross-sectional area of an inlet of the chamber, wherein the chamber comprises an active heating part that faces the heater and that is directly heated by the heater, and a passive heating part that is disposed outside of the active heating part and that is indirectly heated by the heater to a predetermined temperature range, and wherein the inlet is located at the passive heating part to prevent the working fluid, which returns through the inlet after moving in the flow tube, from being reheated and flowing backward.

2. The evaporator of claim 1, wherein a flow tube is coupled to the outlet of the chamber, and is configured to extend towards an upper side of the case.

3. The evaporator of claim 1, wherein the heating unit includes:

a mounting frame that covers at least a portion of the chamber, the heater being fixed to the mounting frame;

a lead wire configured to electrically connect the heater to a controller; and a sealing member that covers the heater and that is configured to block moisture from entering the heater.

4. The evaporator of claim 3, wherein the mounting frame includes:

a base frame that has a shape corresponding to the chamber; and a protrusion part that protrudes toward a lower side of the base frame from a rear surface of the base frame, and that covers at least a side part of the heater fixed to the rear surface of the base frame, and wherein the sealing member is accommodated in a recessed space defined by the protrusion part so as to cover the heater.

5. The evaporator of claim 4, wherein the heater includes:

a base plate made of a ceramic material and fixed to a rear surface of the mounting frame;

a heating element comprising a resistor patterned on the base plate and configured to generate heat based on a drive signal received from the controller; and a terminal formed on the base plate and configured to electrically connect the heating element to the lead wire.

6. The evaporator of claim 3, wherein the heating unit further comprises an insulation member that is interposed between a rear surface of the heater and the sealing member and that is configured to limit heat transfer from the heater.

7. The evaporator of claim 1, wherein the heating tube covers at least a part of the cooling tube.

8. The evaporator of claim 7, wherein the chamber extends inwardly toward the cooling tube.

9. The evaporator of claim 1, wherein the cooling tube covers at least a part of the heating tube.

10. The evaporator of claim 9, wherein the outlet includes:

a first outlet and a second outlet provided at both sides of the chamber, respectively, wherein the inlet includes a first inlet and a second inlet provided at both sides of the chamber, respectively, and wherein the flow tube is coupled to the first and second outlets, respectively, extendedly formed so as to be far from the chamber at both sides of the chamber, extendedly formed to get near to the chamber, and coupled to the first and second inlets, respectively.

11. The evaporator of claim 1, wherein the metal frame defines a first opening and a second opening that are connected to the heating tube and that are disposed at one end of the metal frame, and wherein the evaporator further comprises a coupling pipe that connects the first opening to the second opening, the heating tube defining a circulation path that is a closed loop type path through which the working fluid is circulated, and that includes the coupling piping.

12. The evaporator of claim 1, wherein the chamber has a rectangular parallelepiped shape, and wherein the outlet and the inlet are disposed at one side of the chamber and spaced apart from each other.

* * * * *